US007175247B2

(12) United States Patent
Takenaka et al.

(10) Patent No.: US 7,175,247 B2
(45) Date of Patent: Feb. 13, 2007

(54) LIQUID DISCHARGER AND LIQUID DISCHARGE ADJUSTMENT METHOD

(75) Inventors: Kazuyasu Takenaka, Tokyo (JP); Iwao Ushinohama, Kanagawa (JP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 109 days.

(21) Appl. No.: 10/915,605

(22) Filed: Aug. 10, 2004

(65) Prior Publication Data

US 2005/0057599 A1 Mar. 17, 2005

(30) Foreign Application Priority Data

Aug. 14, 2003 (JP) ..... 2003-293566

(51) Int. Cl.
*B41J 29/38* (2006.01)

(52) U.S. Cl. ..... 347/14; 347/15; 347/77; 347/19

(58) Field of Classification Search ..... 347/14, 347/15, 19, 77
See application file for complete search history.

(56) References Cited

U.S. PATENT DOCUMENTS

| | | | |
|---|---|---|---|
| 6,179,402 B1 | 1/2001 | Suzuki et al. | |
| 6,390,583 B1 | 5/2002 | Kato et al. | |
| 6,916,077 B2 * | 7/2005 | Eguchi et al. | 347/12 |

FOREIGN PATENT DOCUMENTS

| | | |
|---|---|---|
| JP | 2000-185403 | 4/2000 |

* cited by examiner

*Primary Examiner*—Lamson Nguyen
(74) *Attorney, Agent, or Firm*—Robert J. Depke; Rockey, Depke, Lyons & Kitzinger LLC

(57) ABSTRACT

Since the pulse currents supplied to a pair of heating resistors can be controlled at once based on a color signal from a color tone detector, the discharge angle of ink droplets can be easily adjusted to an angle that provides a predetermined color tone.

8 Claims, 19 Drawing Sheets

LIQUID DISCHARGER AND LIQUID DISCHARGE ADJUSTMENT METHOD

BACKGROUND OF THE INVENTION

1. Field of the Invention

The present invention relates to a liquid discharger that discharges a droplet of pressurized liquid from an outlet onto an object by pressurizing the liquid with a force generated by a pressure-generating element and a method for adjusting the discharge.

2. Description of the Related Art

As a liquid discharger, an inkjet printer for recording images and text is known. An inkjet printer is advantageous in that the operational cost is low, the size of the apparatus is small, and producing a colored image is easy. The ink of an inkjet printer is stored in an ink cartridge for each color, such as yellow, magenta, cyan, and black, and is supplied to ink chambers in a printer head.

In such an inkjet printer, the ink supplied to the ink chambers is pressurized by a pressure-generating element, such as a heating resistor, disposed inside the ink chamber and, then, is discharged from a minute ink outlet on each ink chamber (i.e., a nozzle). More specifically, the ink in an ink chamber is heated by a heating resistor, and an air bubble is generated inside the ink chamber filled with ink. The size of the air bubble increases and the ink is pressurized until the ink is finally discharged from the nozzle. Images and text are printed by making the discharged ink land on an object such as a sheet of recording paper.

There are two types of inkjet printers: a so-called serial printer and a so-called line printer. For the serial printer, an ink head moves in the width direction of the recording paper (i.e., the direction substantially orthogonal to the feeding direction of the recording paper) to discharge ink of a predetermined color onto a sheet of recording paper. For the line printer, ink is discharged from nozzles aligned along substantially the entire width of the recording paper.

A serial printer stops feeding the recording paper when the ink head moves in the direction substantially orthogonal to the feeding direction of the recording paper. Then, the serial printer prints on the recording paper by repeatedly moving the ink head while ink is discharged on the recording paper.

A line printer generally has a fixed ink head. The line printer prints on a sheet of recording paper being uninterruptedly fed by discharging ink from a linear ink head fixed across the width of the sheet of recording paper.

Accordingly, since the line printer, unlike the serial printer, does not move the ink head, it is advantageous in three points: 1) high printing speed faster than a serial printer is possible; 2) ink capacity can be increased by increasing the size of each ink cartridge; and 3) the structures of head chips, head cartridges, and ink tanks can be simplified.

In the above-described line printer, the recording paper must be fed. Therefore, the printing accuracy of the image and text depends on the accuracy of the timing the ink lands on the recording paper being fed.

To solve such a problem, the timing of the ink landing on the recording paper is controlled in the line printer, for example, by using a servo motor for controlling the feeding speed of the recording paper so that the recording paper is fed at a constant speed and by generating a pulse synchronized with the feeding of the recording paper by an encoder.

Even when a servo motor is used, as described above, expansion and contraction of an image may be prevented, but slight unevenness in the color tone (i.e., unevenness in the density of the color) caused by an instantaneous change in the timing of the ink landing on the recording paper can not be prevented. In other words, if the control of the feeding speed of the recording paper by the servo motor is delayed or quickened instantaneously for merely several microseconds, the landing position of the ink discharged onto this portion of the recording paper will be displaced. Consequently, when a series of ink droplets are discharged, the ink droplets will land close together in some parts and far apart in other parts, causing change in the concentration of the color that appears as unevenness in the density of the color or white stripes. Uneven color density and white stripes appearing in a direction orthogonal to the feeding direction of the recording paper become prominent, for example, when an image is printed at a constant color tone.

In generally, the line printer prints by feeding a sheet of recording paper so that the sheet passes right under the fixed ink head having nozzles aligned in the direction perpendicular to the feeding direction of the recording paper. For this reason, if the discharge direction of the ink discharged from each of the nozzles on the line is not stabilized, a faulty nozzle having a discharge direction different from the other normal nozzles will cause uneven color density and stripes.

On the other hand, for a serial printer, an image can be printed by overlapping the ink. More specifically, by setting a predetermined area where a first printed image and a second printed image overlaps for when an image is printed while the paper feeding is stopped, the concentration (tone) of the color is averaged and unevenness color density and white stripes formed in the feeding direction of the recording paper can be suppressed. Overlapping the ink, however, may prevent uneven color density and white stripes, but, at the same time, may increase the printing time and the amount of ink used for printing.

To solve such problems, a method for controlling the direction of ink discharged from a printer head is disclosed, for example, in Japanese Unexamined Patent Application Publication No. 2000-185403. The discharge direction is controlled by disposing a plurality of heating resistors so that they oppose the nozzles for discharging ink and are plane symmetrical to each other in respect of the plane including the center line of the nozzles to change the heating value of each of the heating resistors.

A head chip having the above-mentioned heating resistors controls the direction of ink discharged from nozzles by changing the heating value of each heating resistor. Therefore, if the heating value of each heating resistor is not controlled appropriately and ink is not discharged in a predetermined direction, the ink does not land on the target landing position on the recording paper. Accordingly, the printed image cannot be improved and degradation of the image cannot be prevented. The landing position is also affected by the distance between the nozzle and the recording paper. When this distance changes, the landing point of the ink droplet also changes, making it difficult to improve the printed image and to prevent degradation of the printed image. To make the ink discharged from each nozzle land at a target landing position, the heating value of each heating resistor (i.e., the amount of energy, such as an electrical current, supplied to each heating resistor for heating each heating resistor) must be determined to obtain a predetermined discharge angle corresponding to the distance between the nozzle and the recording paper.

To determine the amount of energy, such as an electrical current, supplied to one of the heating resistors for heating the heating resistor, the relationship between the discharge angle and the amount of energy must be calculated based on an observation of the trajectory of the ink discharged from the corresponding nozzle, and the distance between the nozzle and the recording paper must be measured. Another method for determining the heating value of each heating resistor for discharging ink at a predetermined discharge angle is to observe the change in the landing positions on the recording paper of the ink discharged at different discharge angles. In this method, however, much equipment including measuring instruments and time are required to calculate the heating value of each heating resistor for discharging ink at a predetermined discharge angle. The structure of the system also becomes large, and reducing the size, weight, and energy consumption becomes difficult.

SUMMARY OF THE INVENTION

An object of the present invention is to provide a liquid discharger capable of controlling the discharge direction of a droplet and preventing a decrease in image quality, and a liquid discharge adjusting method capable of easily adjusting the discharge direction of a droplet.

The liquid discharger according to the present invention includes discharge means, which further includes a liquid chamber for storing liquid, a supplier for supplying liquid to the liquid chamber, at least two pressure-generating elements for pressuring the liquid stored in the liquid chamber disposed in each liquid chamber, and a discharging outlet for discharging a droplet pressurized by each pressure-generating element from the liquid chamber to an object, discharge controlling means for driving each pressure-generating element and controlling the discharge angle of the droplet when discharged from the discharging outlet, and color tone detection means for detecting the color tone of a droplet-landing region of the object, wherein the discharge controlling means drives each pressure-generating element based on a color tone detection signal from the color detection means and adjusts the discharge angle.

In this liquid discharger, the discharge controlling means drives each pressure-generating element based on a color tone detection signal in accordance with the color tone of the droplet-landing region detected by the color tone detection means. In this way, the discharge angle when a droplet is discharged from the discharging outlet can be adjusted to an angle of which a predetermined color tone (i.e., color density and brightness) for the droplet-landing region on the object can be obtained.

In the liquid discharge adjusting method according to the present invention, each of the pressure-generating elements of the discharge means is driven by the discharge controlling means so that droplets are discharged from the discharge outlet at different discharge angles, the droplets land on the object at different discharge angles, the color tone of the droplets on the object is detected by the color tone detection means, and the discharge angle is adjusted by driving each pressure-generating element in accordance with a color tone detection signal from the color tone detection means.

In the liquid discharge adjusting method according to the present invention, the discharge controlling means drives each pressure-generating element in accordance with a color tone detection signal of the color tone of the droplet-landing region on the object detected by the color tone detection means. In this way, the discharge angle is adjusted to an angle of which a predetermined color tone for the droplet-landing region on the object can be obtained.

According to the present invention, the droplet-landing position on the object according to the distance from the discharging outlet to the object can be detected by measuring the color tone of the droplet-landing region on the object, and the discharge angle can be adjusted.

In this way, according to the present invention, the image quality can be easily optimized even when the thickness of the object changes, the discharge angle changes due to the environment, or the type of liquid discharged onto the object changes.

According to the present invention, individual differences, such as differences in the distance from the discharging outlet to the object or differences in the discharge means, may be easily adjusted.

BRIEF DESCRIPTION OF THE DRAWINGS

FIG. 19 is illustrates the discharge controlling unit controlling the discharge direction of a ink droplet i, wherein

FIG. 23 illustrates test patterns on a sheet of recording paper printed by the inkjet printer, wherein FIG. 23A is a schematic view illustrating the ink droplet landing points for when the color tone is the lightest, FIG. 23A is a schematic view illustrating the ink droplet landing points for when the color tone is dark, FIG. 23C is a schematic view illustrating the ink droplet landing points for when the color tone is the darkest, FIG. 23D is a schematic view illustrating the ink droplet landing points for when the color tone changes to light from dark, FIG. 23E is a schematic view illustrating the ink droplet landing points for when the color tone changes back from dark to light; and FIG. 24 illustrates another embodiment of a printer head according to the present invention, wherein

DESCRIPTION OF THE PREFERRED EMBODIMENTS

Figure 1:
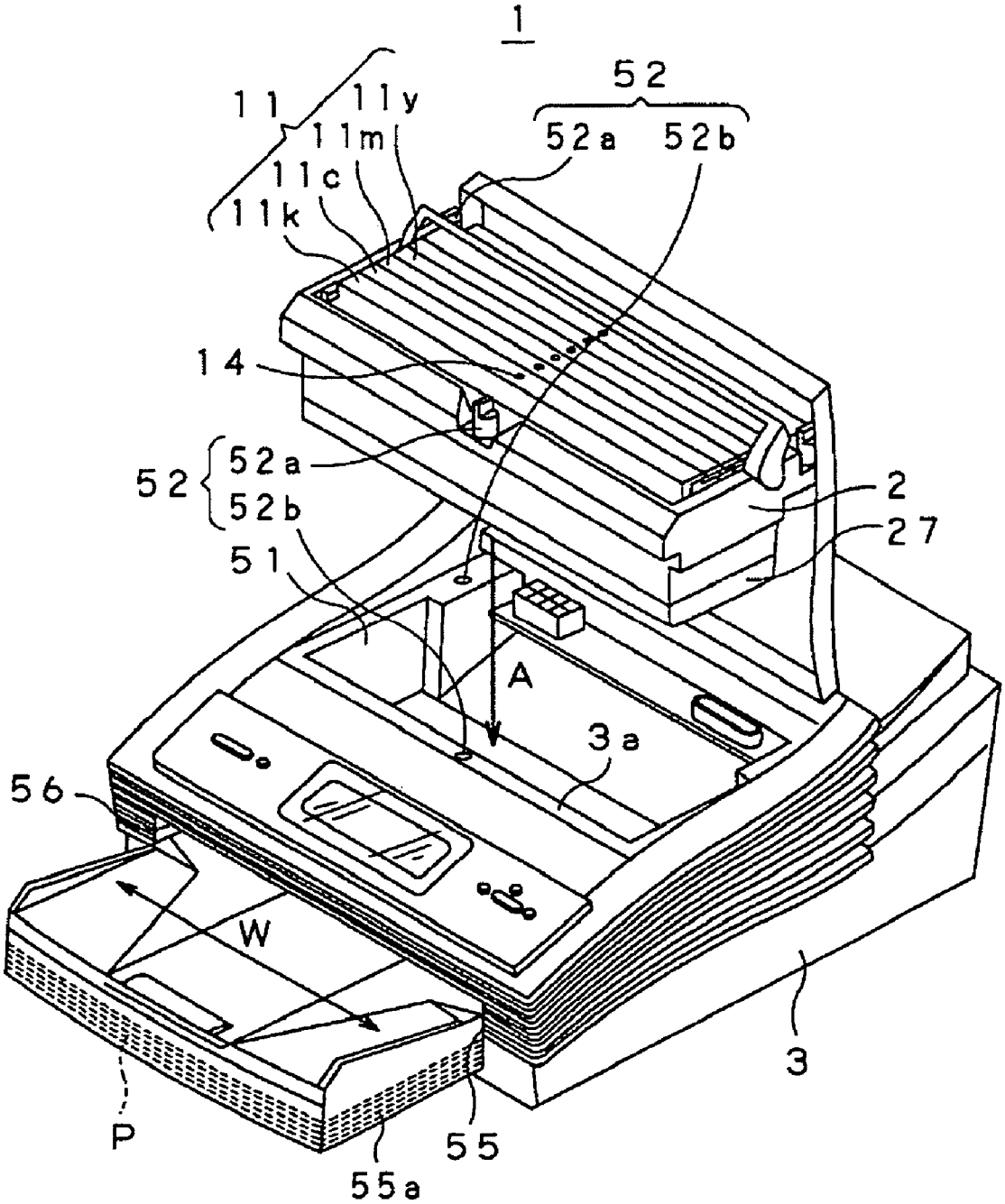
FIG. 1 is a perspective view of an inkjet printer according to the present invention.

A liquid discharger and liquid discharge adjustment method according to the present invention will now be described by referring to the drawings. An inkjet printer (hereinafter referred to as a 'printer') 1, as illustrated in FIG. 1, is for printing images and text on a sheet of recording paper P delivered in a predetermined direction by discharging ink onto the sheet of recording paper P. The printer 1 is a line printer having ink discharging outlets (nozzles) aligned substantially linearly across the printing width of the sheet of recording paper P in the direction indicated by an arrow W in FIG. 1, which is the width direction of the sheet of recording paper P.

The printer 1 includes an inkjet printer head cartridge (hereinafter referred to as a head cartridge) 2 for discharging ink 4 (refer to FIG. 3) stored in ink cartridges 11*y*, 11*m*, 11*c*, and 11*k* and a printer body 3 holding the head cartridge 2. The head cartridge 2 is removable from the printer body 3, and the ink cartridges 11*y*, 11*m*, 11*c*, and 11*k* which supply the ink 4 are removable from the head cartridge 2. The ink cartridge 11*y* contains yellow ink, the ink cartridge 11*m* contains magenta ink, the ink cartridge 11*c* contains cyan ink, and the ink cartridge 11*k* contains black ink. The head cartridge 2 and the ink cartridges 11*y*, 11*m*, 11*c*, and 11*k* are disposable and can be replaced.

The printer 1 includes a tray 55*a* for storing a stack of recording paper P, the tray 55*a* being disposed in a tray insertion slot formed on the forward bottom of the printer body 3. Sheets of recording paper P stored in the tray 55*a* are supplied to the printer body 3. When the tray 55*a* is inserted from the front of the tray insertion slot of the printer body 3, a paper feeding mechanism 54 (refer to FIG. 16) feeds a sheet of the recording paper P from a paper feeding slot 55 toward the back of the printer body 3. The feeding direction of the sheet of recording paper P sent to the back of the printer body 3 is reversed by a reverse roller 83. The sheet of recording paper P is then sent to the front of printer body 3 through a return path above the forward path. Until the sheet of recording paper P sent from the back to the front of the printer body 3 is discharged from a paper discharge slot 56, print data corresponding to text data and graphical data input from an information processing apparatus such as a personal computer are printed on the sheet of recording paper P as text and images.

The head cartridge 2 for printing text and images on the sheet of recording paper P is installed into the printer body 3 from the upper surface into a direction A indicated in FIG. 1. To print text and images on the sheet of recording paper P, the head cartridge 2 discharges the ink 4 onto the sheet of recording paper P delivered by the paper feeding mechanism 54. The head cartridge 2 removable from the printer body 3 and the ink cartridges 11*y*, 11*m*, 11*c*, and 11*k* removable from the head cartridge 2 will now be described by referring to the drawings.

Figure 2:
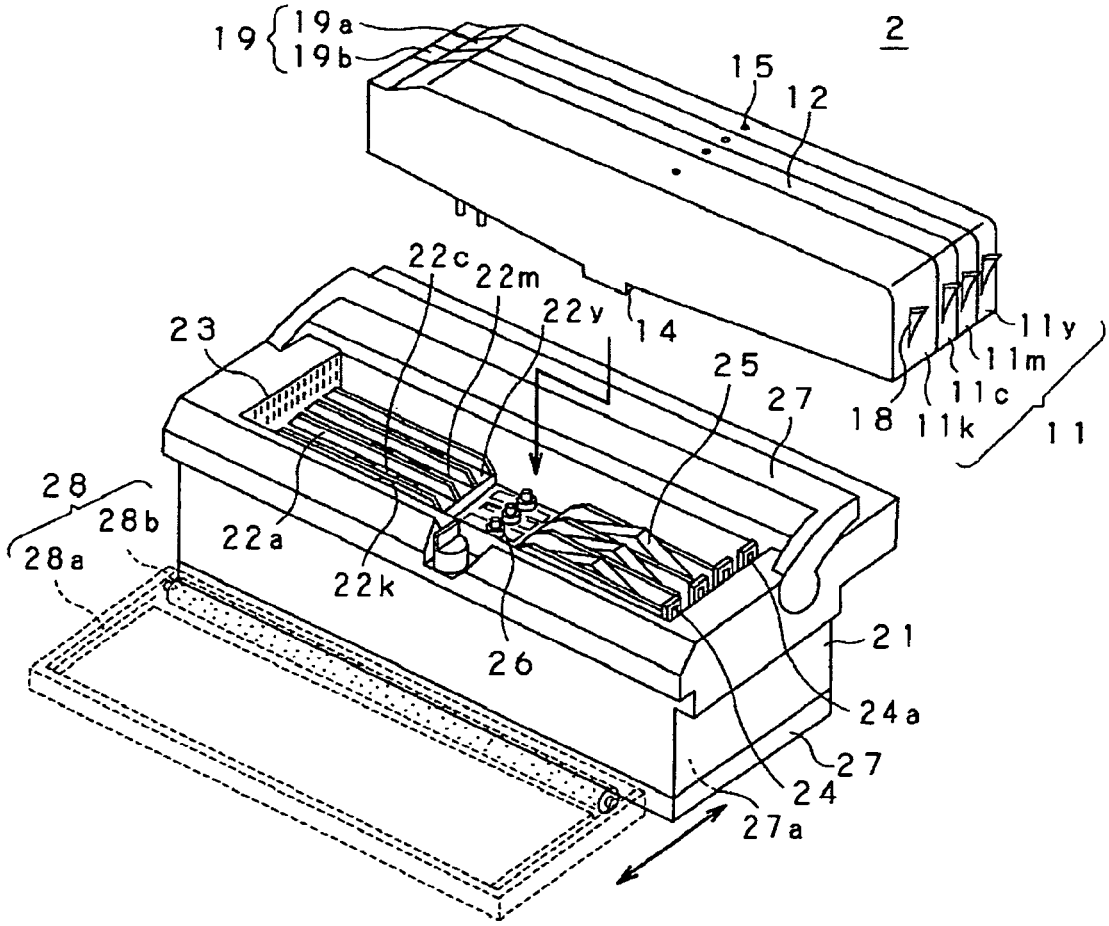
FIG. 2 is a perspective view of an inkjet printer head cartridge included in the inkjet printer according to the present invention.
Figure 3:
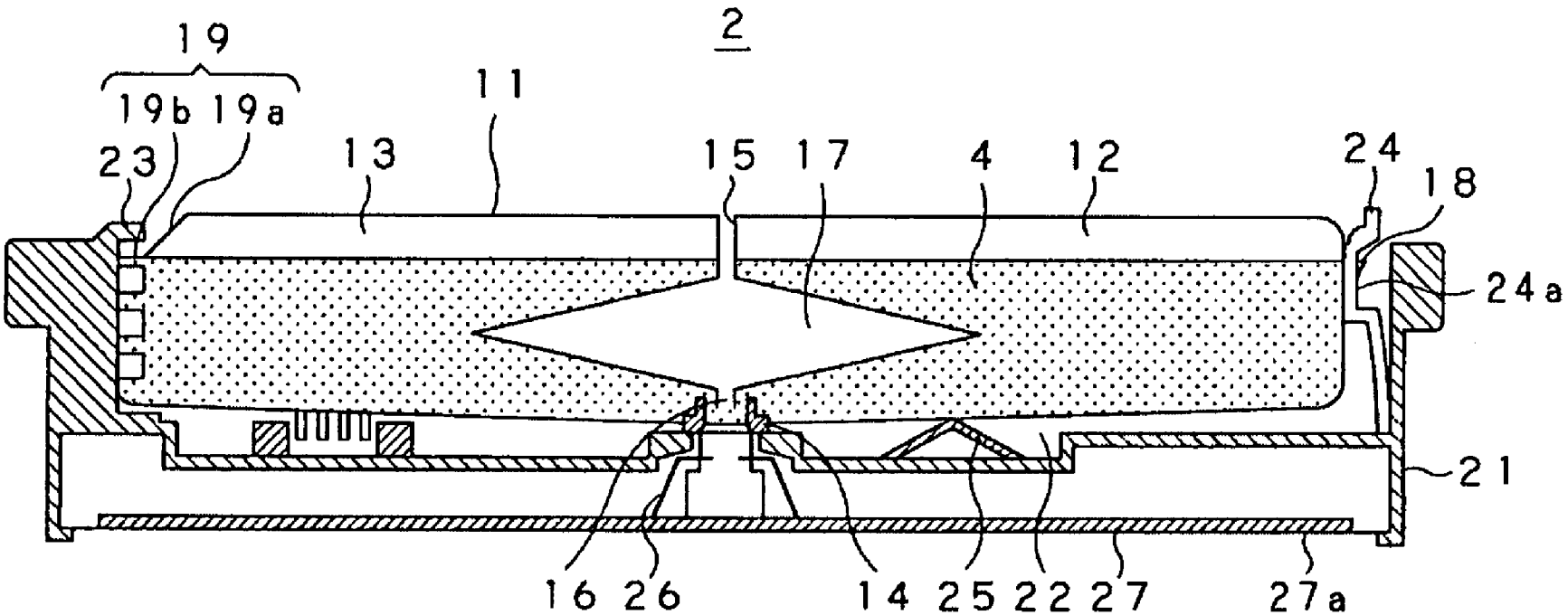
FIG. 3 is a cross-sectional view of the inkjet printer head cartridge included in the inkjet printer according to the present invention.

The head cartridge 2 discharges the ink 4, which is a conductive liquid, as fine particles by applying pressure to the ink 4 generated by an electro-thermal or electro-mechanical pressuring unit. In particular, the head cartridge 2 includes a cartridge body 21, as illustrated in FIGS. 2 and 3; the ink cartridges 11*y*, 11*m*, 11*c*, and 11*k* containing the ink 4 are disposed in the cartridge body 21. Hereinafter, each of the 'ink cartridges 11*y*, 11*m*, 11*c*, and 11*k*' may be simply referred to as the 'ink cartridge 11'.

The ink cartridge 11, illustrated in FIG. 3, removable from the head cartridge 2 includes a strong, ink-resistant cartridge container 12 that is an injection molded container composed of resin such as polypropylene. The cartridge container 12 has a rectangular shape wherein the longitudinal length is substantially the same length as the width of the recording paper P. The cartridge container 12 is shaped so that its inner volume is maximized to hold as much ink as possible.

The cartridge container 12 of the ink cartridge 11 includes an ink storage 13 for storing the ink 4, an ink supply unit 14 for supplying the ink 4 from the ink storage 13 to the cartridge body 21, a communicating hole 15 for taking in air from the outside into the ink storage 13, an air channel 16 for sending the air taken in from the communicating hole 15 to the ink storage 13, an ink reservoir 17 for temporarily retaining the ink 4 between the communicating hole 15 and the air channel 16, and a latching protrusion 18 and a latching portion 19 for latching the ink cartridge 11 to the cartridge body 21.

The ink storage 13 includes a space for containing the ink 4 surrounded by an air-tight material. The ink storage 13 has a rectangular shape wherein the longitudinal length (the length of the side substantially orthogonal to the feeding direction of the recording paper P) is substantially the same length as the width of the recording paper P.

The ink supply unit 14 is disposed in substantially the center of the lower portion of the ink storage 13. The ink supply unit 14 is a nozzle forming a slight protrusion communicating with the ink storage 13. The tip of the nozzle is engaged with an after-mentioned connector 26 of the head cartridge 2. In this way, the cartridge container 12 of the ink cartridge 11 and the cartridge body 21 of the head cartridge 2 are connected.

Figure 4:
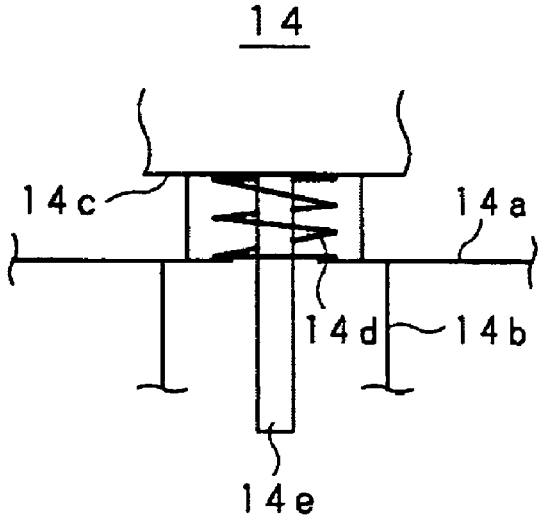
FIG. 4 is schematic view illustrating a closed supply port of a liquid supplier with an ink cartridge disposed in the inkjet printer head cartridge.
Figure 5:
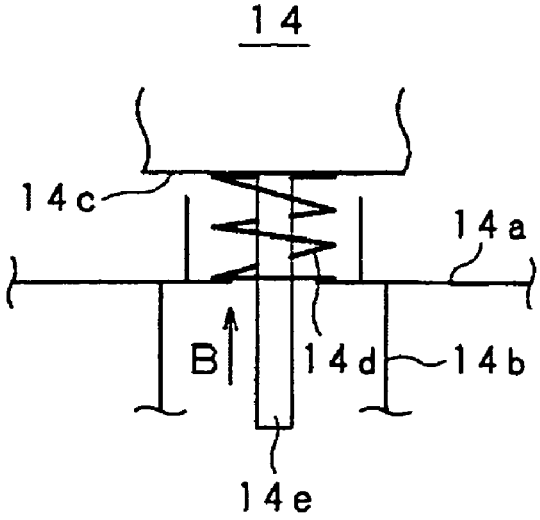
FIG. 5 is schematic view illustrating an open supply port of a liquid supplier with an ink cartridge disposed in the inkjet printer head cartridge.

As illustrated in FIGS. 4 and 5, the ink supply unit 14 includes a supply port 14*b* for supplying the ink 4 on the bottom surface 14*a* of the ink cartridge 11, a valve 14*c* for opening and closing the supply port 14*b*, a coil spring 14*d* urging the valve 14*c* in a direction that closes the supply port 14*b*, and an opening pin 14*e* for opening and closing the valve 14*c*. As illustrated in FIG. 4, before the ink cartridge 11 is disposed in the cartridge body 21 of the head cartridge 2, the supply port 14*b* is closed by the valve 14*c* urged by the coil spring 14*d*. When the ink cartridge 11 is disposed in the cartridge body 21, as illustrated in FIG. 5, the opening pin 14*e* is pushed upwards in the direction opposite to the urging direction of the coil spring 14*d* by the connector 26 of the cartridge body 21. Accordingly, the opening pin 14*e* pushes the valve 14*c* against the urging force of the coil spring 14*d* and opens the supply port 14*b*. Consequently, the ink supply unit 14 is connected with the connector 26 of the head cartridge 2, causing the ink storage 13 to communicate with an ink holder 31 (refer to FIG. 6). In this way, the ink 4 can be supplied to the ink holder 31.

When the ink cartridge 11 is pulled out from the connector 26 on the head cartridge 2 or, in other words, when the ink cartridge 11 is removed from loading section 22, the valve 14*c* is released from the opening pin 14*e* and moves in the direction urged by the coil spring 14*d* to close the supply port 14*b*. In other words, the ink 4 is prevented from leaking from the ink storage 13 even when the tip of the ink supply unit 14 is pointing downwards immediately before the ink cartridge 11 is disposed in the cartridge body 21. When the ink cartridge 11 is pulled out from the cartridge body 21, the valve 14*c* immediately closes the supply port 14*b* to prevent the ink 4 from leaking out of the tip of the ink supply unit 14.

As illustrated in FIG. 3, the communicating hole 15 is a ventilation hole for taking in air from the outside of the ink cartridge 11 into the ink storage 13. The communicating hole 15 is formed on the upper surface of the cartridge container 12 (substantially in the center of the upper surface in the drawing) facing the outside so that outside air can be taken into the ink storage 13 even when the head cartridge 2 is disposed in the loading section 22. When the ink cartridge 11 is disposed in the cartridge body 21 and the ink 4 starts to flow from the ink storage 13 to the cartridge body 21, the communicating hole 15 takes in air from the outside into the ink cartridge 11; the amount of air taken in is the same volume as the ink 4 that has flowed out.

The air channel 16 connects the ink storage 13 with the communicating hole 15, and guides the air taken in from the communicating hole 15 into the ink storage 13. In this way, when the amount of ink 4 inside the ink storage 13 is decreased and the inner pressure of the ink storage 13 is reduced while the cartridge body 21 is disposed in the ink cartridge 11, air is sent into the ink storage 13 through the air channel 16. Hence, the inner pressure of the ink storage 13 is maintained at equilibrium, and the ink 4 can be properly supplied to the cartridge body 21.

The ink reservoir 17 is formed between the communicating hole 15 and the air channel 16. The ink reservoir 17 is formed to temporarily retain the ink 4 when the ink 4 leaks out from the air channel 16 communicating with the ink storage 13 and to prevent the ink 4 from leaking directly outside the head cartridge 2.

The ink reservoir 17 is shaped substantially as a diamond wherein the longer diagonal line extends in the longitudinal direction of the ink storage 13. The air channel 16 is formed at the lowest vertex (the lower end of the shorter diagonal line) of the diamond shaped ink reservoir 17. The ink 4 in the ink reservoir 17 that has flowed in from the ink storage 13 can flow back to the ink storage 13 through the air channel 16. The communicating hole 15 is formed at the upper vertex (the upper end of the shorter diagonal line) of the diamond shaped ink reservoir 17. The communicating hole 15 prevents the ink 4 in the ink reservoir 17 that has flowed in from the ink storage 13 from leaking outside the head cartridge 2.

The latching protrusion 18 is a protrusion formed on the one of the short sides of the ink cartridge 11. The latching protrusion 18 engages with an engagement hole 24*a* formed on a latching lever 24 on the cartridge body 21 of the head cartridge 2. The upper surface of the latching protrusion 18 is substantially orthogonal to the side of the ink cartridge 11 and the lower surface is an inclined surface connecting the upper surface and the side of the ink storage 13. The latching portion 19 is formed on the side of the ink cartridge 11 opposite from the side on which the latching protrusion 18 is formed. The latching portion 19 includes an inclined surface 19*a* contacting one of the ends of the upper surface of the cartridge container 12 and a flat surface 19*b* substantially parallel with the upper surface of the cartridge container 12. The height of the side of the cartridge container 12 having the flat surface 19*b* is a step lower than the upper surface of the cartridge container 12. The latching portion 19 engages with latching pieces 23 of the cartridge body 21. The latching portion 19 is formed on the side of the ink cartridge 11 that is first inserted into the head cartridge 2. When the ink cartridge 11 is inserted into the loading section 22 and engaged with the latching pieces 23, the latching portion 19 functions as a rotational supporting point for inserting the ink cartridge 11 into the loading section 22.

In addition to the above-described, the ink cartridge 11 may include, for example, a remaining ink detector for detecting the amount of remaining ink 4 inside the ink storage 13 and an identifying unit for identifying the ink cartridges 11*y*, 11*m*, 11*c*, and 11*k*.

Next, the head cartridge 2 including the ink cartridges 11*y*, 11*m*, 11*c*, and 11*k* for storing the yellow, magenta, cyan, and black ink, respectively, will be described.

As illustrated in FIGS. 2 and 3, the head cartridge 2 includes the cartridge body 21. The cartridge body 21 includes the four loading sections 22*y*, 22*m*, 22*c*, and 22*k* (hereinafter may also be referred to as the 'loading section 22') for disposing the ink cartridges 11*y*, 11*m*, 11*c*, and 11*k*, respectively, the latching piece 23 and the latching lever 24 for fixing the ink cartridge 11, an urging member 25 for urging the ink cartridge 11 in the ejecting direction, the connector 26 connected to the ink supply unit 14 to supply the ink 4, a printer head 27 for discharging the ink 4, and a head cap 28 for protecting the printer head 27.

The loading section 22 in which the ink cartridge 11 is disposed is a depression opening upwards. The four ink cartridges 11*y*, 11*m*, 11*c*, and 11*k* are disposed in a direction substantially orthogonal to the width direction of the recording paper P; in other words, the ink cartridges 11*y*, 11*m*, 11*c*, and 11*k* are aligned in the direction the sheet of recording paper P is delivered. The loading section 22 extends in the same direction to store the ink cartridges 11*y*, 11*m*, 11*c*, and 11*k*. The ink cartridges 11*y*, 11*m*, 11*c*, and 11*k* are stored in the cartridge body 21.

As illustrated in FIG. 2, there are four loading sections 22 where the ink cartridges 11*y*, 11*m*, 11*c*, and 11*k* are disposed. The yellow ink cartridge 11*y* is disposed in the loading section 22*y*, the magenta ink cartridge 11 is disposed in the loading section 22*m*, the cyan ink cartridge 11*c* is disposed in the loading section 22*c*, and the black ink cartridge 11*k* is disposed in the loading section 22*k*. Each of the loading sections 22*y*, 22*m*, 22*c*, and 22*k* are separated by a wall 22*a*. Since black ink is consumed the most in general, the black ink cartridge 11*k* has the largest ink content. Thus, the black ink cartridge 11*k* has the largest cartridge width. Therefore, in accordance with the black ink cartridge 11*k*, the loading section 22*k* has a larger width compared to the other loading sections 22*y*, 22*m*, and 22*c*.

As illustrated in FIG. 3, the latching pieces 23 are formed at the edge of the opening of the loading section 22. The latching pieces 23 are formed on one of the edges of the loading section 22 in the longitudinal direction and engage with the latching portion 19 of the ink cartridge 11. The ink cartridge 11 is disposed in the loading section 22 by first obliquely inserting a first end having the latching portion 19 into the loading section 22. Then, a second end, which is the other end without the latching portion 19, is inserted into the loading section 22 by pivoting the ink cartridge 11 around the rotational support point, which is the point where the latching portion 19 is engaged with the latching pieces 23. In this way, the ink cartridge 11 can be easily disposed in the loading section 22.

The latching lever 24 is made by bending a flat spring. The latching lever 24 is formed on the side of the loading section 22 opposite to the side having the latching pieces 23 or, in other words, the longitudinal end opposite to the latching pieces 23. The base of the latching lever 24 is formed integrally with the bottom surface of the longitudinal end of the loading section 22 opposite to the latching pieces 23. The tip of the latching lever 24 is formed so that it is slightly separated from the side of the loading section 22 by a resilient force. The engagement hole 24*a* is formed on the tip of the latching lever 24. The latching lever 24 is resiliently deformed when the ink cartridge 11 is inserted into the loading section 22. In this way, the engagement hole 24*a* is engaged with the latching protrusion 18 to fix the ink cartridge 11 to the loading section 22.

As illustrated in FIG. 3, the urging member 25 is disposed on the bottom surface of the loading section 22 on the same side as the latching lever 24 so that a flat spring is bent to urge the ink cartridge 11 in the direction that removes the ink cartridge 11 from the loading section 22. The urging member 25 has a tip formed by bending the flat spring and resiliently deforms so that it slightly separates from the bottom surface. In other words, the tip urges the bottom surface of the ink cartridge 11. The urging member 25 functions as an ejecting member for removing the ink cartridge 11 inserted into the loading section 22. When the engagement of the engagement hole 24*a* of the latching lever 24 and the latching protrusion 18 is released, the ink cartridge 11 is ejected from the loading section 22.

The connector 26 for connecting the ink supply unit 14 of the ink cartridge 11 when the ink cartridge 11 is disposed in the loading section 22 is formed in substantially the center in the longitudinal direction of the loading section 22. The connector 26 functions as an ink channel for supplying the ink 4 from the ink supply unit 14 of the ink cartridge 11 disposed in the loading section 22 to the printer head 27 for discharging the ink 4 disposed on the bottom of the cartridge body 21.

Figure 6:
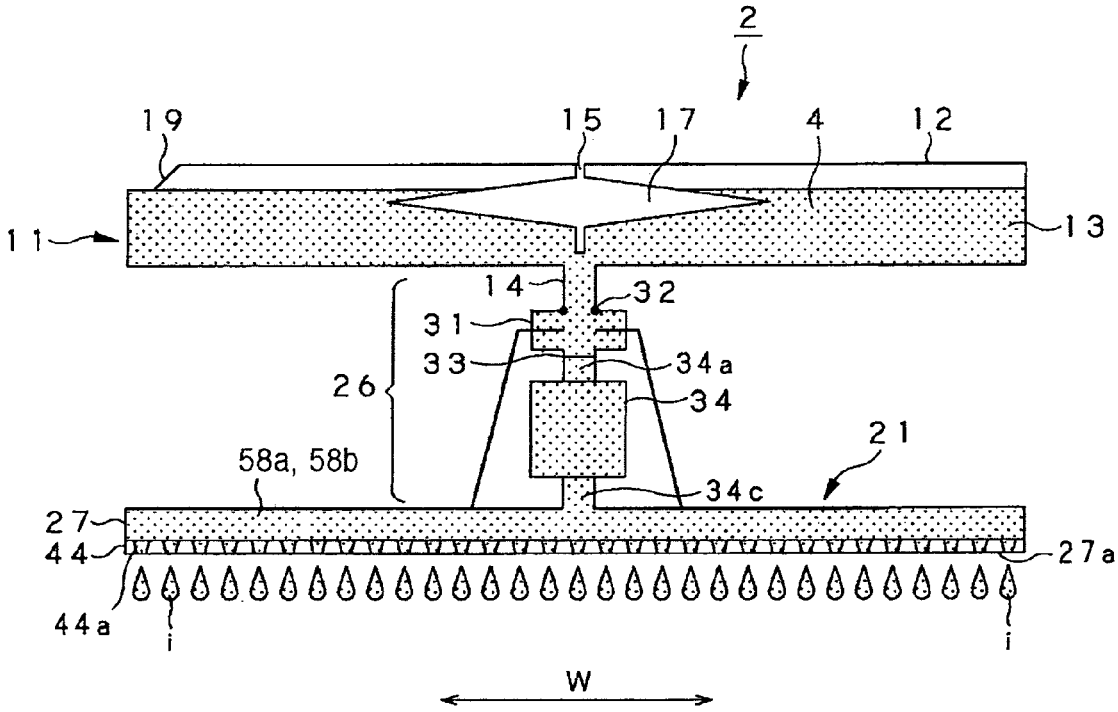
FIG. 6 is a schematic view illustrating the relationship between the ink cartridge of the inkjet printer head cartridge and a printer head.

In particular, as illustrated in FIG. 6, the connector 26 includes the ink holder 31 for holding the ink 4 supplied from the ink cartridge 11, a sealing member 32 for sealing the ink supply unit 14 connected to the connector 26, a filter 33 for removing unwanted material in the ink 4, and a valve mechanism 34 for opening and closing the ink channel to the printer head 27.

The ink holder 31 is a space connected to the ink supply unit 14 for holding the ink 4 supplied from the ink cartridge 11. The sealing member 32 is disposed on the upper end of the ink holder 31. The sealing member 32 seals the space between the ink holder 31 of the connector 26 and the ink supply unit 14 of the ink cartridge 11 so that the ink 4 does not leak when the ink supply unit 14 is connected to the ink holder 31. The filter 33 removes dust and dirt that has contaminated the ink 4 when the ink cartridge 11 is removed. The filter 33 is disposed downstream of the ink holder 31.

Figure 7:
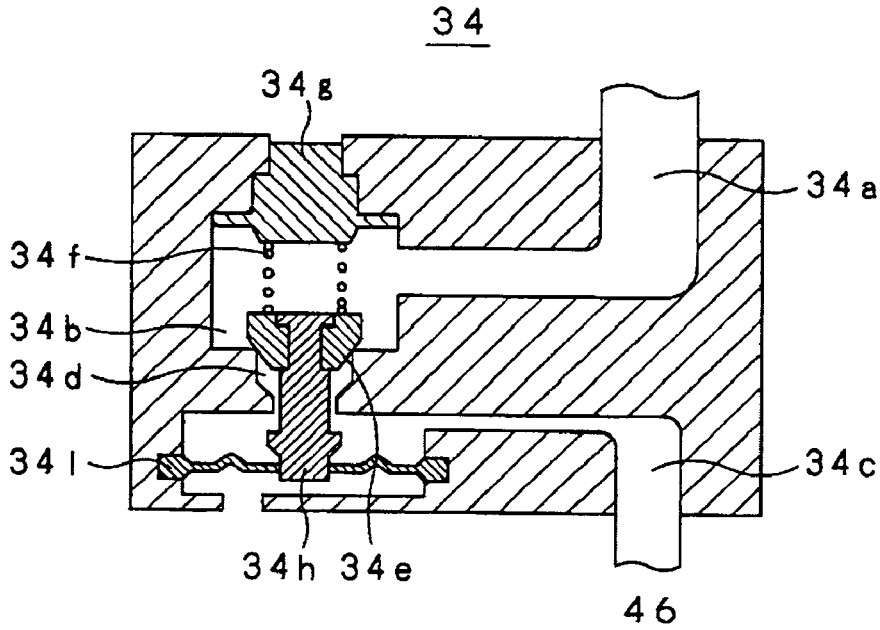
FIG. 7 is a cross-sectional view of a closed valve of the valve mechanism of the connecting portion of the ink cartridge.
Figure 8:
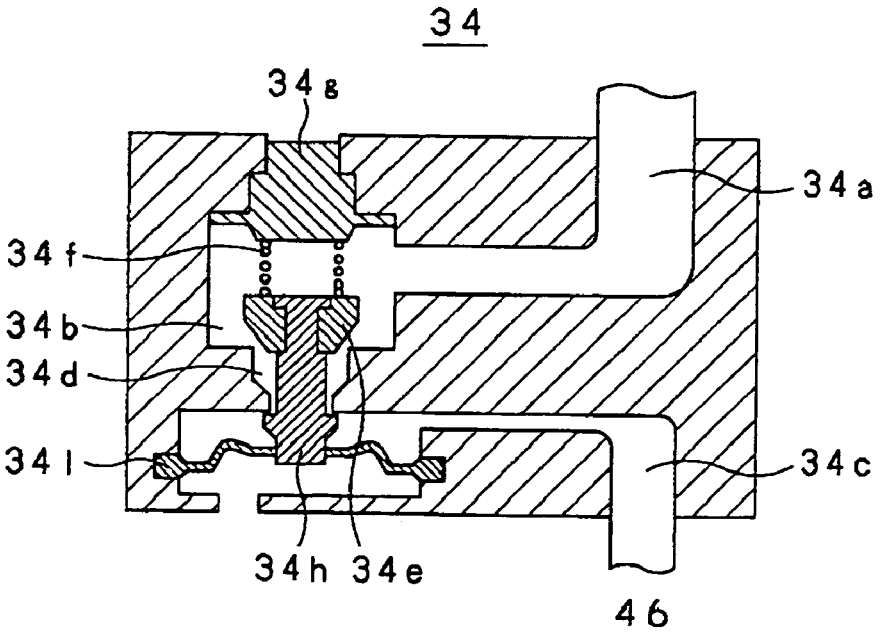
FIG. 8 is a cross-sectional view of an open valve of the valve mechanism of the connecting portion of the ink cartridge.

As illustrated in FIGS. 7 and 8, the valve mechanism 34 includes an ink inflow channel 34*a* through which the ink 4 is supplied from the ink holder 31, an ink chamber 34*b* in which the ink 4 flows from the ink inflow channel 34*a*, an ink outflow channel 34*c* through which the ink 4 flows from the ink chamber 34*b*, and an opening 34*d* connecting the ink inflow channel 34*a* and the ink outflow channel 34*c* of the ink chamber 34*b*, a valve 34*e* for opening and closing the opening 34*d*, an urging member 34*f* for urging the valve 34*e* in the direction that closes the opening 34*d*, a negative pressure adjustment screw 34*g* for adjusting the force of the urging member 34*f*, a valve shaft 34*h* connected with the valve 34*e*, and a diaphragm 34*i* connected with the valve shaft 34*h*.

The ink inflow channel 34*a* is a supply channel connected with the ink storage 13 so that the ink 4 inside the ink storage 13 can be supplied to the printer head 27 through the ink holder 31. The ink inflow channel 34*a* is extended from the bottom surface of the ink holder 31 to the ink chamber 34*b*. The ink chamber 34*b* is a space shaped substantially as a rectangular parallelepiped joining the ink inflow channel 34*a*, the ink outflow channel 34*c*, and the opening 34*d*. The ink 4 flows into the ink chamber 34*b* from the ink inflow channel 34*a* and flows out of the ink outflow channel 34*c* through the opening 34*d*. The ink 4 is supplied from the ink chamber 34*b* through the opening 34*d*. The ink outflow channel 34*c* is a supply channel connected to the printer head 27 and extends from the bottom surface of the ink chamber 34*b* to the printer head 27.

The valve 34*e* is a valve separating the ink inflow channel 34*a* and the ink outflow channel 34*c* by closing the opening 34*d* and is disposed inside the ink chamber 34*b*. The valve 34*e* moves up and down by the urging force of the urging member 34*f*, the restoring force of the diaphragm 34*i* connected to the valve 34*e* via the valve shaft 34*h*, and the negative pressure of the ink 4 in the ink outflow channel 34*c*. When the valve 34*e* is at a lower position, it closes the opening 34*d* by sectioning the ink chamber 34*b* into two sections and isolating the ink inflow channel 34*a* from the ink outflow channel 34*c*. When the valve 34*e* is at an upper position by opposing the urging force of the urging member 34*f*, the valve 34*e* does not separate the ink chamber 34*b* into two sections, and, thus, the ink 4 can be supplied to the printer head 27. The valve 34*e* is composed of, for example, a rubber material such as an elastomer, to maintain high occlusiveness.

The urging member 34*f* is, for example, a compressed coil spring and connects the negative pressure adjustment screw 34*g* and the valve 34*e* between the upper surface of the valve 34*e* and the upper surface of the ink chamber 34*b*. The urging member 34*f* urges the valve 34*e* in the direction that closes the opening 34*d*. The negative pressure adjustment screw 34*g* is a screw for adjusting the urging force of the urging member 34*f*. As described below, by adjusting the negative pressure adjustment screw 34*g*, the negative pressure of the ink 4 moves the valve 34*e* to open or close the opening 34*d*.

The valve shaft 34*h* is a shaft for connecting the valve 34*e* fixed to one end of the valve shaft 34*h* and the diaphragm 34*i* fixed on the other end of the valve shaft 34*h*. The diaphragm 34*i* is a thin resilient plate connected to one end of the valve shaft 34*h*. The diaphragm 34*i* includes a surface facing the ink outflow channel 34*c* of the ink chamber 34*b* and another surface facing the outside. The diaphragm 34*i* bends towards the outside of the ink outflow channel 34*c* according to the negative pressure of the atmosphere and the ink 4.

The valve 34*e* of the valve mechanism 34 having the above-described structure, as illustrated in FIG. 7, is pushed against the opening 34*d* of the ink chamber 34*b* by the urging forces of the urging member 34*f* and the diaphragm 34*i* to close the opening 34*d*. When the ink 4 is discharged from the printer head 27 and the negative pressure of the ink 4 in the section of the ink chamber 34*b* on the side of the ink outflow channel 34*c* separated by the opening 34*d* increases, the diaphragm 34*i* is pressed downwards due to the negative pressure of the ink 4, as illustrated in FIG. 8. Then, the valve shaft 34*h* and the valve 14*c* are pushed up against the urging force of the urging member 34*f*. At this time, the opening 34*d* connecting the ink inflow channel 34*a* and the ink outflow channel 34*c* is opened, and the ink 4 is supplied from the ink inflow channel 34*a* to the ink outflow channel 34*c*. Subsequently, the negative pressure of the ink 4 is decreased, and the diaphragm 34*i* returns to its original state by its restoring force. The valve shaft 34*h* and the valve 34*e* are pulled up by the urging force of the urging member 34*f* to close the opening 34*d* of the ink chamber 34*b*. The valve mechanism 34 repeats the above-described movement every time the ink 4 is discharged and the negative pressure of the ink 4 increases.

When the amount of ink 4 inside the ink storage 13 decreases because the ink 4 is supplied to the ink chamber 34*b*, the outside air enters from the air channel 16 into the ink cartridge 11. The air entering the ink cartridge 11 is sent to the upper portion of the ink cartridge 11. In this way, the head cartridge 2 returns to equilibrium, which is the state before ink droplets i are discharged from nozzles 44*a*. In equilibrium, there is almost no ink 4 in the air channel 16.

As illustrated in FIG. 6, the printer head 27 is disposed along the bottom surface of the cartridge body 21. The after-mentioned nozzles 44*a* of the printer head 27 are outlets for discharging the ink droplets i by being supplied with the ink 4 via the connector 26. The nozzles 44*a* for each color ink are aligned across the width of the sheet of recording paper P in the direction indicated by an arrow W in FIG. 6.

The head cap 28 is a cover for protecting the printer head 27, as illustrated in FIG. 2, and is removed when the printer head 27 performs printing. The head cap 28 includes grooves 28*a* formed in the opening direction of the head cap 28 and a cleaning roller 28*b* for absorbing excess ink 4 attached to the discharge surface 27*a* of the printer head 27. The head cap 28 is slid along the grooves 28*a* in the direction orthogonal to the longitudinal direction of the ink cartridge 11 to cover or uncover the ink cartridge 11. When the head cap 28 slides along the grooves 28*a*, the cleaning roller 28*b* rotates against the discharge surface 27*a* of the printer head 27 to remove excess ink 4 from the discharge surface 27*a* of the printer head 27. The cleaning roller 28*b* is for example, composed of a material having a high water-absorbing rate. When printing is not performed, the head cap 28 covers the printer head 27 so that the ink 4 is dried.

The head cartridge 2 having the above-described structure further includes, for example, a detector for detecting the remaining amount of ink inside the ink cartridge 11 and a detector for detecting whether there is any ink 4 in the ink cartridge 11 when the connector 26 is connected to the ink supply unit 14.

Figure 9:
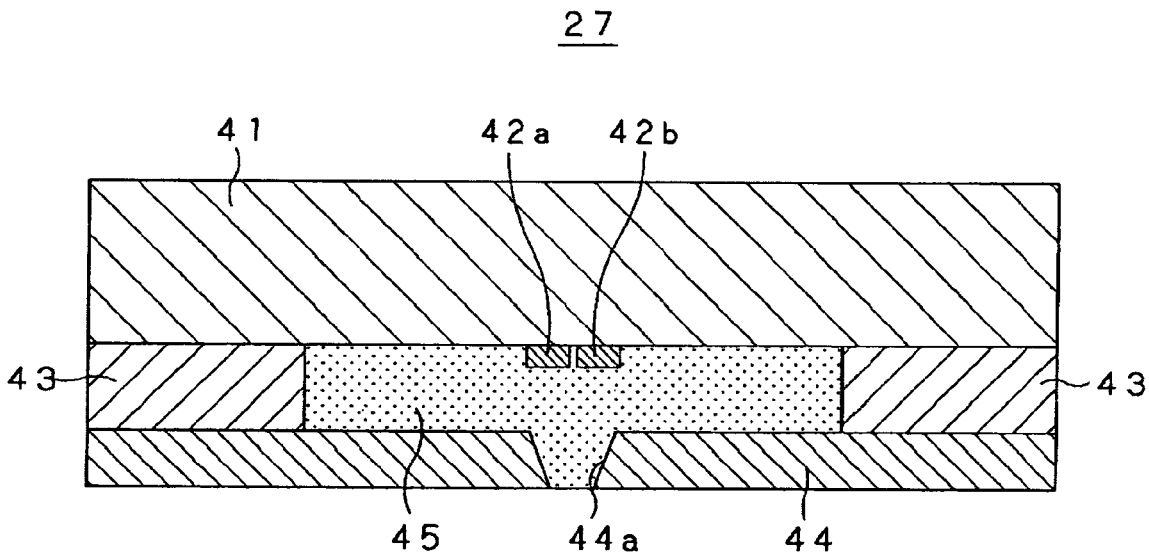
FIG. 9 is a cross-section view of the printer head of the inkjet printer head cartridge.
Figure 10:
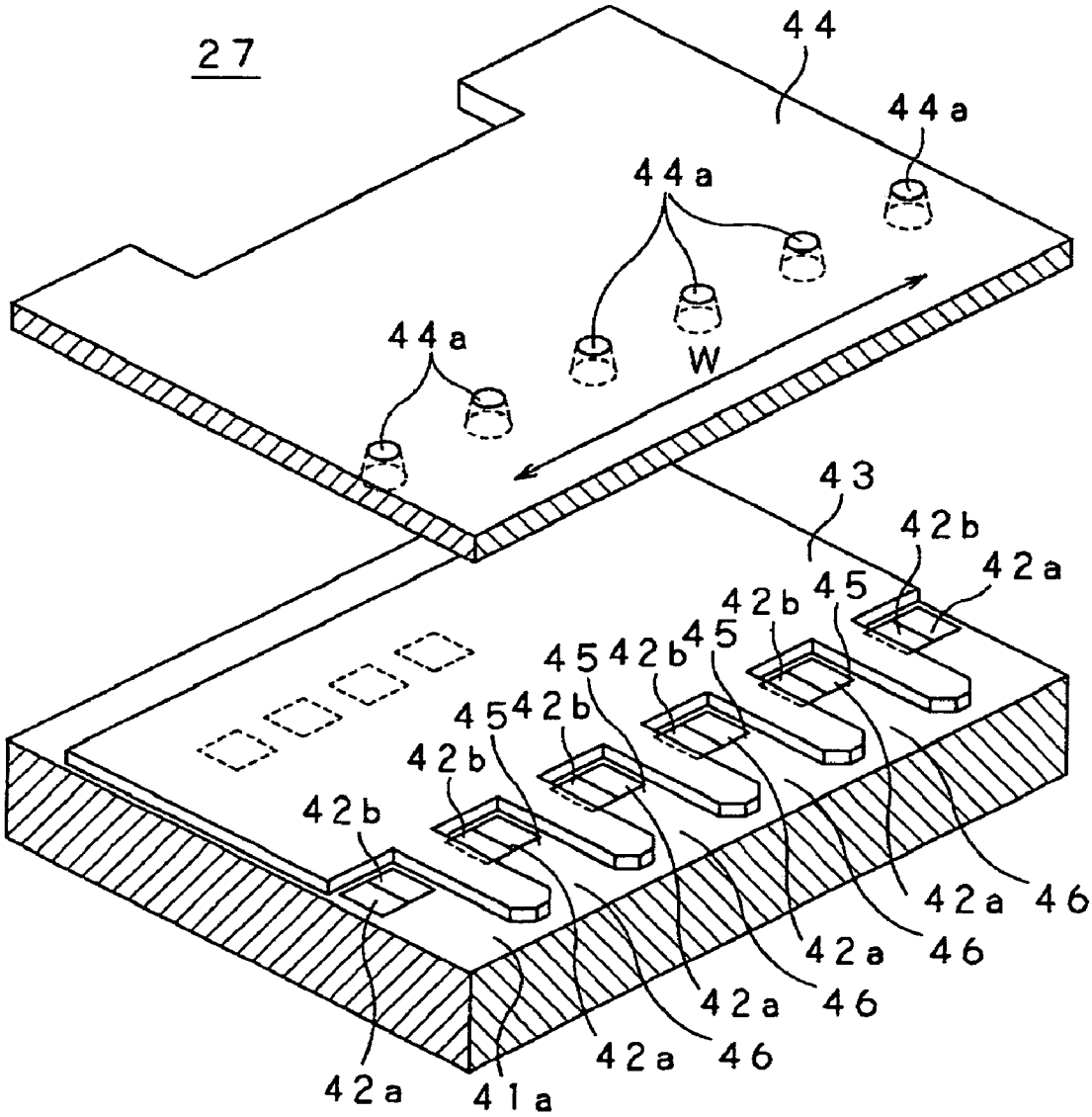
FIG. 10 is an exploded perspective view of the printer head.
Figure 11:
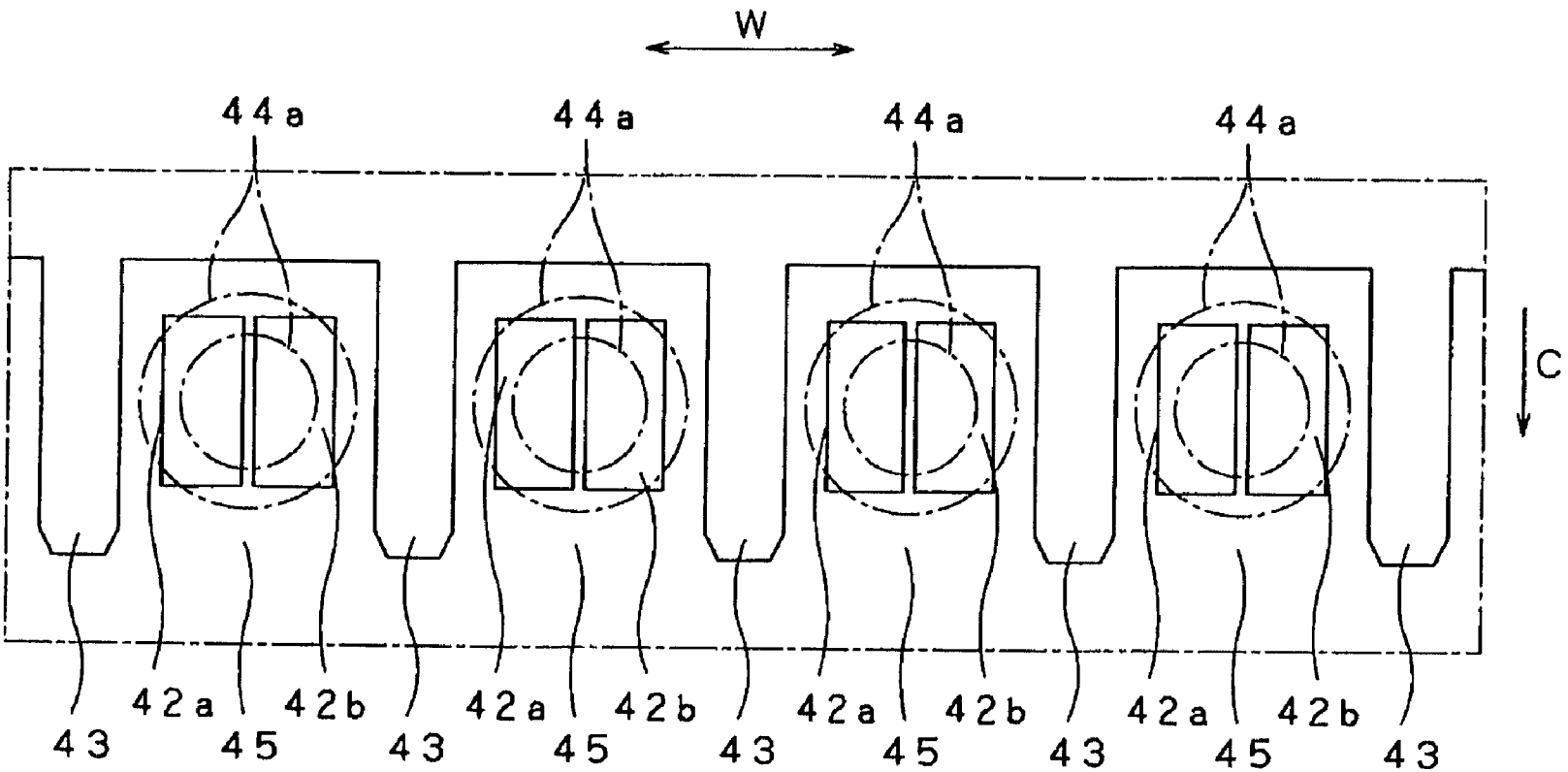
FIG. 11 is a plan view of the printer head.

As illustrated in FIGS. 9, 10, and 11, for each color ink, the above-mentioned printer head 27 includes a circuit board 41 making up the base, pairs of heating resistors 42*a* and 42*b* aligned in the direction substantially orthogonal to the feeding direction of the sheet of recording paper P (i.e., the width direction of the sheet of recording paper P), a film 43 for preventing leakage of the ink 4, a nozzle sheet 44 having a plurality of nozzles 44*a* for discharging the ink 4 as droplets, ink chambers 45 that are spaces surrounded by the circuit board 41, and ink channels 46 for supplying the ink 4 to the ink chambers 45.

The circuit board 41 is a semi conductive substrate composed of silicon. On one surface 41*a* of the circuit board 41, the pairs of heating resistors 42*a* and 42*b* are disposed. The pairs of heating resistors 42*a* and 42*b* are connected to the after-mentioned discharge control circuit 63 on the circuit board 41. The discharge control circuit 63 is an electric circuit made up of components such as a logic integrated circuit (IC) and a driver transistor.

The heating resistors 42*a* and 42*b* are so-called pressure-generating elements that generate heat from the electrical power supplied from the discharge control circuit 63 and increase the inner pressure of the ink chambers 45 by heating the ink 4. The ink 4 heated by the heating resistors 42*a* and 42*b* is discharged from the nozzles 44*a* on the nozzle sheet 44 as droplets.

The film 43 is stacked on the surface 41*a* of the circuit board 41. The film 43 is composed of, for example, a photo-curable dry film resist. Once the film 43 is stacked on substantially the entire surface 41*a* of the circuit board 41, unwanted portions of the film 43 are removed by a photo-lithography process. Depressions are formed in the film 43 so that the film 43 surrounds the pairs of heating resistors 42*a* and 42*b*. The portions of the film 43 that surround the pairs of heating resistors 42*a* and 42*b* make up parts of the ink chambers 45.

The nozzle sheet 44 is a sheet having the nozzles 44*a* for discharging ink droplets i and is stacked on the film 43 on the side opposite from the circuit board 41. The nozzles 44*a* are minute circular holes formed on the nozzle sheet 44. Each of the nozzles 44*a* is formed in a position opposing the heating resistors 42*a* and 42*b*. The nozzle sheet 44 makes up parts of the ink chambers 45.

The ink chambers 45 are spaces surrounded by the circuit board 41, the pairs of heating resistors 42*a* and 42*b*, the film 43, and the nozzle sheet 44. The ink 4 is supplied from the ink channel 46 to the ink chambers 45. The ink 4 in the ink chambers 45 is heated by the pairs of heating resistors 42*a* and 42*b*, and the inner pressure of the ink chambers 45 increases. The ink channels 46 are connected to the ink outflow channel 34*c* of the connector 26. The ink 4 is supplied from the ink cartridge 11 connected to the connector 26 to the ink channels 46. Then, the ink 4 is supplied to each of the ink chambers 45 communicating with the ink channels 46. In other words, the ink channels 46 communicate with the connector 26. In this way, the ink 4 supplied from the ink cartridge 11 flows into the ink channels 46 and fills the ink chambers 45.

The printer head 27 has about 100 to 5,000 ink chambers 45 having the pair of heating resistors 42*a* and 42*b*. The pairs of heating resistors 42*a* and 42*b* in the ink chambers 45 are controlled by a controller of the printer 1 so that the ink 4 in the ink chambers 45 is discharged as ink droplets from the nozzles 44*a* corresponding to the ink chambers 45.

More specifically, the ink chambers 45 are filled with the ink 4 supplied from the ink channels 46 connected to the printer head 27. Then, a pulse current is applied to the heating resistors 42*a* and 42*b* for a very short time, for example, 1 to 3 μsec. In this way, the heating resistors 42*a* and 42*b* are heated quickly, and, thus, the ink 4 in contact with the heating resistors 42*a* and 42*b* is also heated. As a result, a gas bubble is formed in the ink 4 in each of the ink chambers 45. As the gas bubble expands, the ink 4 is pushed (i.e., the ink 4 boils). Consequently, the ink 4 in contact with one of the nozzles 44*a* in the ink chamber 45 having the same volume as the gas bubble is pushed out of the nozzle 44*a* as an ink droplet i. The ink droplet i discharged from the nozzle 44*a* lands on the sheet of recording paper P.

As illustrated in FIG. 11, the ink chamber 45 of the printer head 27 includes the pair of heating resistors 42*a* and 42*b* aligned substantially in parallel. In other words, each ink chamber 45 includes a pair of heating resistors 42*a* and 42*b*. A plurality of pairs of heating resistors 42*a* and 42*b* aligned substantially orthogonal to the feeding direction of the sheet of recording paper P indicated by an arrow C in the FIG. 11 are included in the printer head 27, wherein each of the pairs of heating resistors 42*a* and 42*b* is substantially in parallel to each other in the width direction of the sheet of recording paper P in the direction indicated by an arrow W in the FIG. 11. In FIG. 11, each of the positions of the nozzles 44*a* is indicated by a dashed line.

Since the heating resistors in each ink chamber 45 are made up of two heating resistors 42*a* and 42*b* instead of a single heating resistor, the width of each of the heating resistors 42*a* and 42*b* becomes half the width compared to that of a single heating resistor. Therefore, the resistance of each of the heating resistors 42*a* and 42*b* becomes about twice the value compared to a single heating resistor. When the heating resistors 42*a* and 42*b* are connected serially, the resistance becomes about four times the resistance of a single heating resistor.

To boil the ink 4 inside the ink chambers 45, the pairs of heating resistors 42*a* and 42*b* must be heated by applying a predetermined electric current. The energy generated when the ink 4 boils causes the ink droplets i to be discharged from the nozzles 44*a*. If the resistance of the heating resistors 42*a* and 42*b* is small, a large electric current must applied to the heating resistors 42*a* and 42*b*. According to the present invention, however, the heating resistors 42*a* and 42*b* have a large resistance, and, thus, the ink 4 can be boiled by applying only a small electric current.

For this reason, the size of the printer head 27 may be reduced because the size of the transistor for applying the electric current can be reduced. The resistance of the heating resistors 42*a* and 42*b* can be increased even more by reducing the thickness of the heating resistors 42*a* and 42*b*. However, the heating resistors 42*a* and 42*b* must maintain a predetermined thickness depending on the material and strength of the heating resistors 42*a* and 42*b*. Therefore, the resistance of the heating resistors 42*a* and 42*b* is increased by reducing the size instead of the thickness.

When the heating resistors 42*a* and 42*b* in one of the ink chambers 45 are controlled so that the time required to boil the ink 4 (the bubble generation time) becomes the same for both heating resistors 42*a* and 42*b*, the ink droplet i is discharged perpendicularly downwards from the nozzle 44*a*. When there is a difference in the bubble generation time of the heating resistors 42*a* and 42*b*, gas bubbles are not formed substantially simultaneously. For this reason, the ink droplet i is discharged at an angle wherein the trajectory of the ink droplet i is displaced toward either the heating resistor 42*a* or 42*b*.

Figure 12:
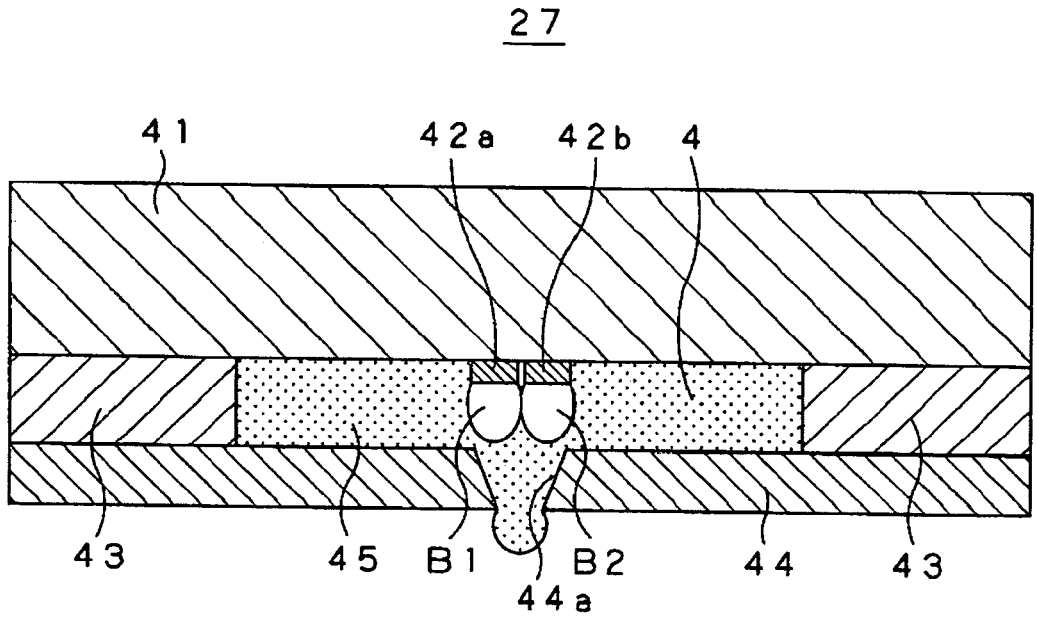
FIG. 12 is a cross-sectional view illustrating the printer head discharging an ink droplet wherein air bubbles of substantially the same size are formed inside an ink chamber.
Figure 13:
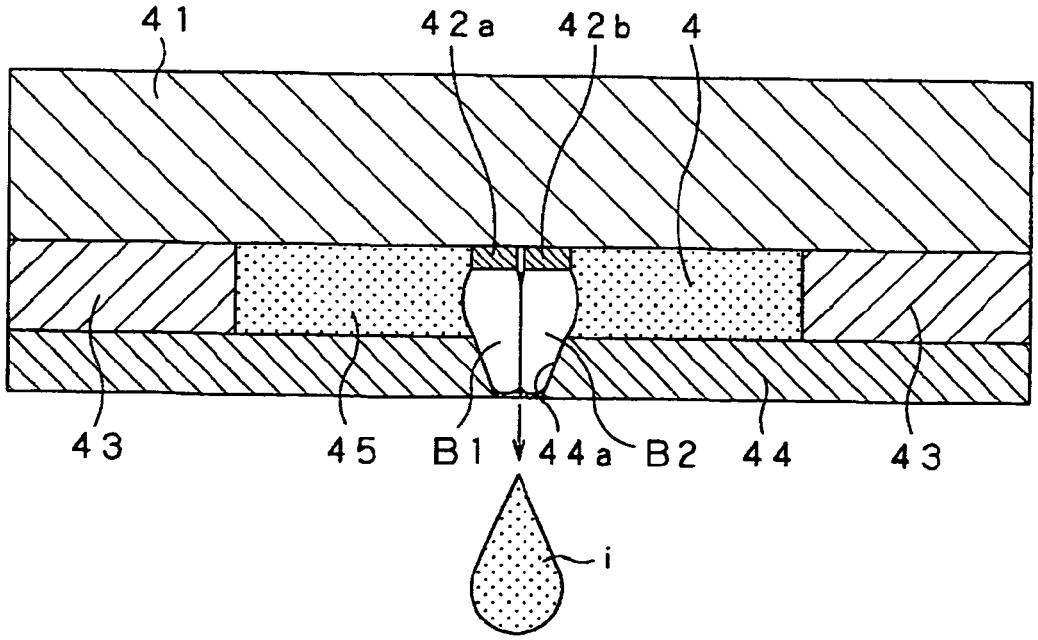
FIG. 13 is a cross-sectional view illustrating the printer head discharging an ink droplet wherein an ink droplet is discharged substantially perpendicularly downward from a nozzle.
Figure 14:
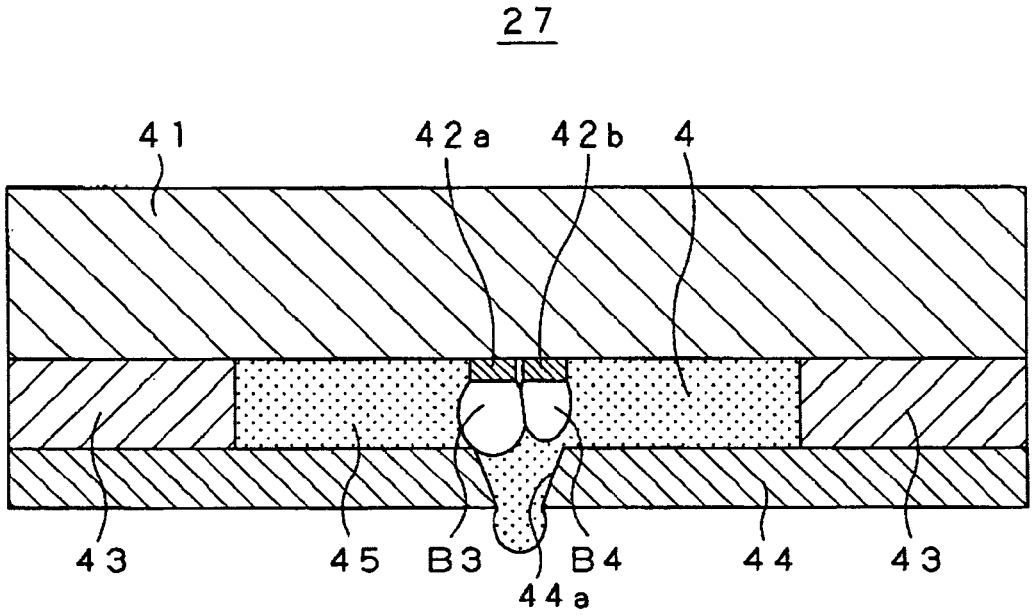
FIG. 14 is a cross-sectional view illustrating the printer head discharging an ink droplet wherein different-sized air bubbles are formed inside an ink chamber.
Figure 15:
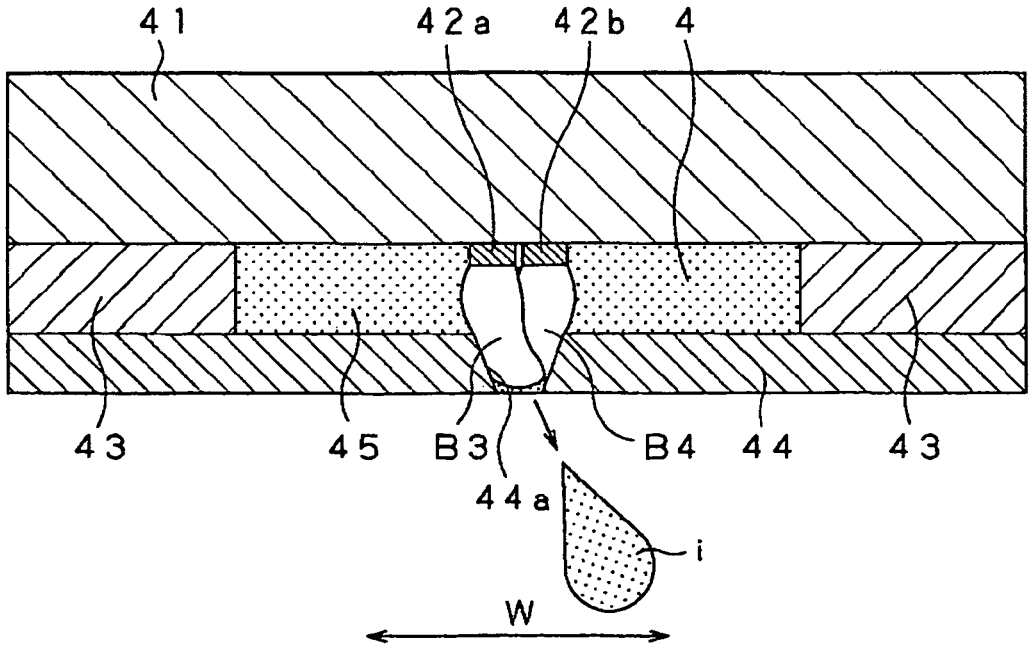
FIG. 15 is a cross-sectional view illustrating the printer head discharging an ink droplet wherein an ink droplet is discharged substantially diagonally from the nozzle.

The mechanism for discharging the ink droplet i is assumed to be as described below. As illustrated in FIG. 12, the ink 4 is supplied from the ink channel 46 to the ink chamber 45 to fill the ink chamber 45. Then, pulse currents are applied substantially simultaneously to both the heating resistors 42*a* and 42*b* to quickly heat the heating resistors 42*a* and 42*b*. As a result, gas bubbles B1 and B2 are generated in the ink 4 that is in contact with the heating resistors 42*a* and 42*b*. The gas bubbles B1 and B2 expand and push a predetermined amount of ink 4 (i.e., the ink 4 boils). As illustrated in FIG. 13, an ink droplet i having the same volume as a sum of the gas bubbles B1 and B2 is pushed out of the nozzle 44*a* and is discharged substantially perpendicularly downwards onto the sheet of recording paper P. As illustrated in FIG. 14, when pulse currents having different values are applied or when pulses currents are applied at different timings to each of the heating resistors 42*a* and 42*b*, gas bubbles B3 and B4 having different sizes are generated on the heating resistors 42*a* and 42*b*, respectively. The gas bubbles B3 and B4 expand and push a predetermined amount of the ink 4. As illustrated in FIG. 15, an ink droplet i having the same volume as a sum of the gas bubbles B3 and B4 is pushed out of the nozzle 44*a*. The trajectory of the discharged ink droplet i is displaced towards the gas bubbles B3 or B4, whichever has a smaller volume, in the direction indicated by an arrow W in FIG. 15 (i.e., the width direction of the sheet of recording paper P). The discharged ink droplet i lands on the sheet of recording paper P.

Next, the printer body 3 making up the printer 1 including the head cartridge 2 having the above-described structure will be described by referring to the drawings.

Figure 16:
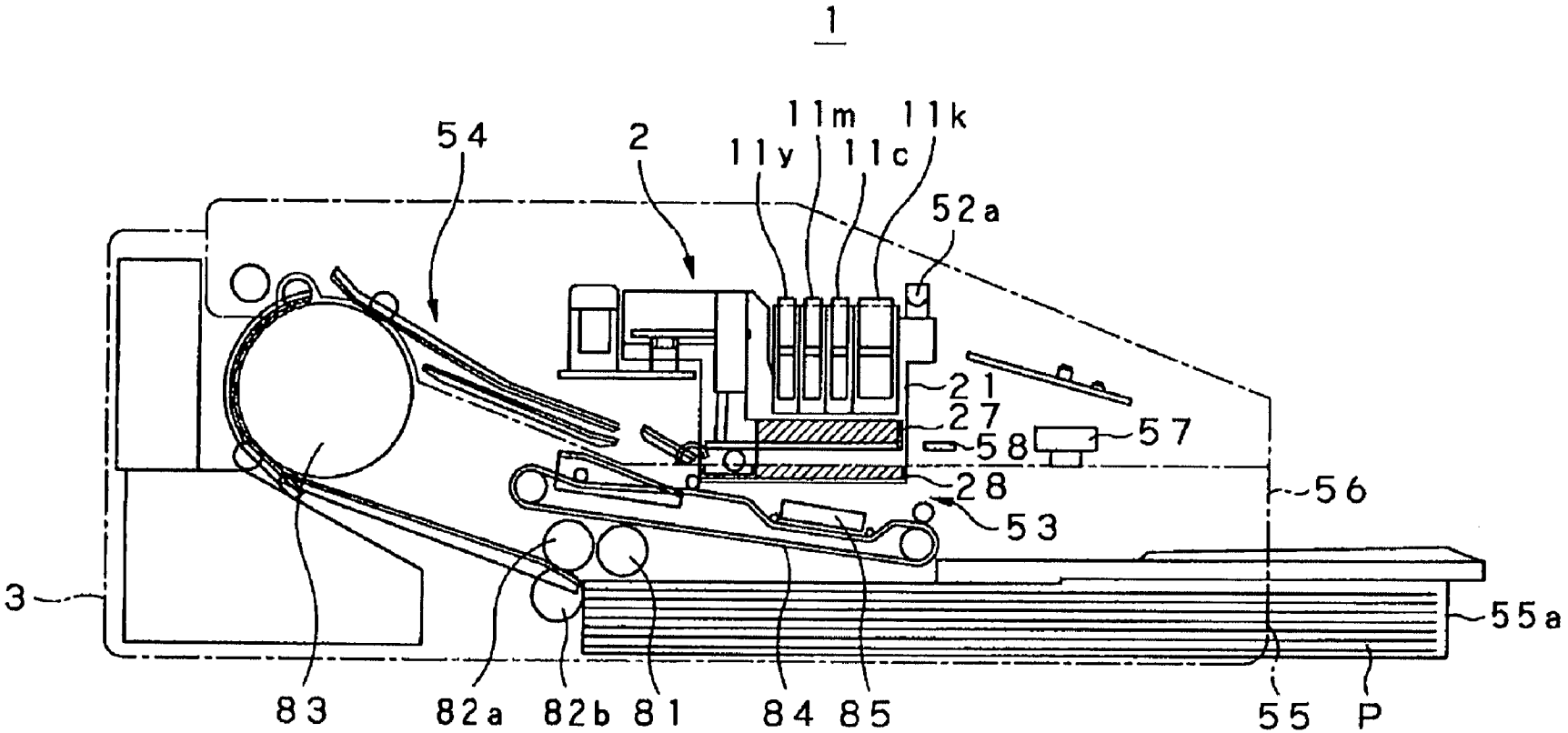
FIG. 16 is a side view of the inkjet printer partially showing the inner structure.

As illustrated in FIGS. 1 and 16, the printer body 3 includes a head cartridge attachment region 51 where the head cartridge 2 is disposed, a head cartridge holding mechanism 52 for holding and fixing the head cartridge 2 at the head cartridge attachment region 51, a head cap opening mechanism 53 for opening and closing the head cap, the paper feeding mechanism 54 for feeding and ejecting the recording paper P, the paper feeding slot 55 for supplying the recording paper P to the paper feeding mechanism 54, a paper ejecting slot 56 for outputting the sheet of recording paper P from the paper feeding mechanism 54, a color tone detector 57 for detecting the condition, i.e., the color tone (density and brightness of color), of the ink droplets i that have been discharged from the printer head 27 and have landed on the main surface of the recording paper P, and a paper position detector 58 for measuring the distance from the discharge surface 27*a* of the printer head 27 to the main surface of the recording paper P.

The head cartridge attachment region 51 is a depression in which the head cartridge 2 is disposed. To print text and images in accordance with the printing data on a delivered sheet of recording paper P, the head cartridge 2 is disposed in the head cartridge attachment region 51 so that the discharge surface 27*a* of the printer head 27 and the surface of the sheet of recording paper P are substantially parallel to each other. The head cartridge 2 has to be replaced on occasion, such as when ink clogging occurs. The head cartridge 2 is a disposable component although it does not have to be replaced as often as the ink cartridge 11. Thus, the ink cartridge 11 is held by the head cartridge holding mechanism 52 and is removable from the head cartridge attachment region 51.

The head cartridge holding mechanism 52 is a mechanism for holding the head cartridge 2 so that it is removable from the head cartridge attachment region 51. The head cartridge holding mechanism 52 holds and fixes the head cartridge 2 at a predetermined position by pressing the head cartridge 2 against a reference surface 3*a* on the printer body 3 while a knob 52*a* on the head cartridge 2 is latched to an urging member such as a spring (not depicted in the drawings) disposed inside a latching hole 52*a*.

The head cap opening mechanism 53 includes a driver for opening and closing the head cap 28 of the head cartridge 2. When printing is performed, the head cap 28 is opened so that the printer head 27 is exposed to the sheet of recording paper P and, when the printing is finished, the head cap 28 is closed to protect the printer head 27.

The paper feeding mechanism 54 includes a driver for delivering the recording paper P. The sheet of recording paper P is supplied from the paper feeding slot 55 and is delivered to the printer head 27 of the head cartridge 2, where the ink droplets i land on the sheet of recording paper P. Then, the printed sheet of recording paper P is delivered to the paper ejecting slot 56 to eject the sheet outside the printer 1. The paper feeding slot 55 is an opening for supplying the recording paper P to the paper feeding mechanism 54. The tray 55*a* is capable of holding a stack of recording paper P. The paper ejecting slot 56 is where the printed sheet of recording paper P on which the ink droplets i have landed is ejected.

The color tone detector 57 is, for example, a reflective densitometer, a luminance sensor, or a scanner, for measuring the color tone (i.e., density and brightness of color) of the ink droplets i that have landed on the main surface of the recording paper P. The color tone detector 57 detects the color tone of the printed sheet of recording paper P and sends a color tone signal such as an electric voltage, which represents digitalized data of parameters, such as the average density and the density distribution, to a control circuit 61 and a controller 68. When noise is generated in the color tone signal, the signal is sent to the controller 68 after the waveform of the signal is shaped and the noise is removed.

The paper position detector 58 is, for example, a laser distance sensor or an ultrasonic distance sensor capable of measuring the distance from the discharge surface 27*a* of the printer head 27 to the main surface of the recording paper P or, in other words, from one of the nozzles 44*a* of the printer head 27 to a point on the main surface of a sheet of the recording paper P substantially perpendicularly downwards from the nozzle 44*a*. The data on the distance from the printer head 27 to the recording paper P is digitalized and sent to the controller 68 of the control circuit 61 as a distance signal. Since, in this way, the distance from one of the nozzles 44*a* of the printer head 27 to a point on the main surface of the sheet of recording paper P substantially perpendicularly downwards from the nozzle 44*a* is measured by the paper position detector 58, printing can be performed with the distance from the nozzle 44*a* to the main surface of the recording paper P being known even when the thickness of the sheet of recording paper P differs. The paper position detector 58 may be embedded in the discharge surface 27*a* of the printer head 27 so that the discharge surface 27*a* and the sensor of the paper position detector 58 are substantially flush with each other.

The control circuit 61 illustrated in FIG. 17 for controlling the printing operation of the printer 1 having the above-described structure will now be described by referring to the drawings.

The control circuit 61 includes a printer driver 62 for driving the head cap opening mechanism 53 and the paper feeding mechanism 54 of the printer body 3, a discharge controller 63 for controlling the electric current supplied to the printer head 27 for the four ink colors, an alerting unit 64 for alerting a user about the amount of each color of ink 4 remaining, an input-output terminal 65 for inputting and outputting a signal to and from an external apparatus, a read only memory (ROM) 66 for storing the control program, a random access memory (RAM) 67 for temporarily storing a color tone signal input from the color tone detector 57 and for outputting a control signal when required, and the controller 68 for controlling each component.

The printer driver 62 controls the head cap opening mechanism 53 so that the head cap 28 is opened and closed by driving the driving motor of the head cap opening mechanism 53 in accordance with a control signal sent from the controller 68. The printer driver 62 feeds a sheet of the recording paper P from the paper feeding slot 55 of the printer body 3 by driving the driving motor of the paper feeding mechanism 54. Then, the printer driver 62 controls the paper feeding mechanism 54 so that the sheet of recording paper P is ejected from the paper ejecting slot 56 after printing is performed.

Figure 18:
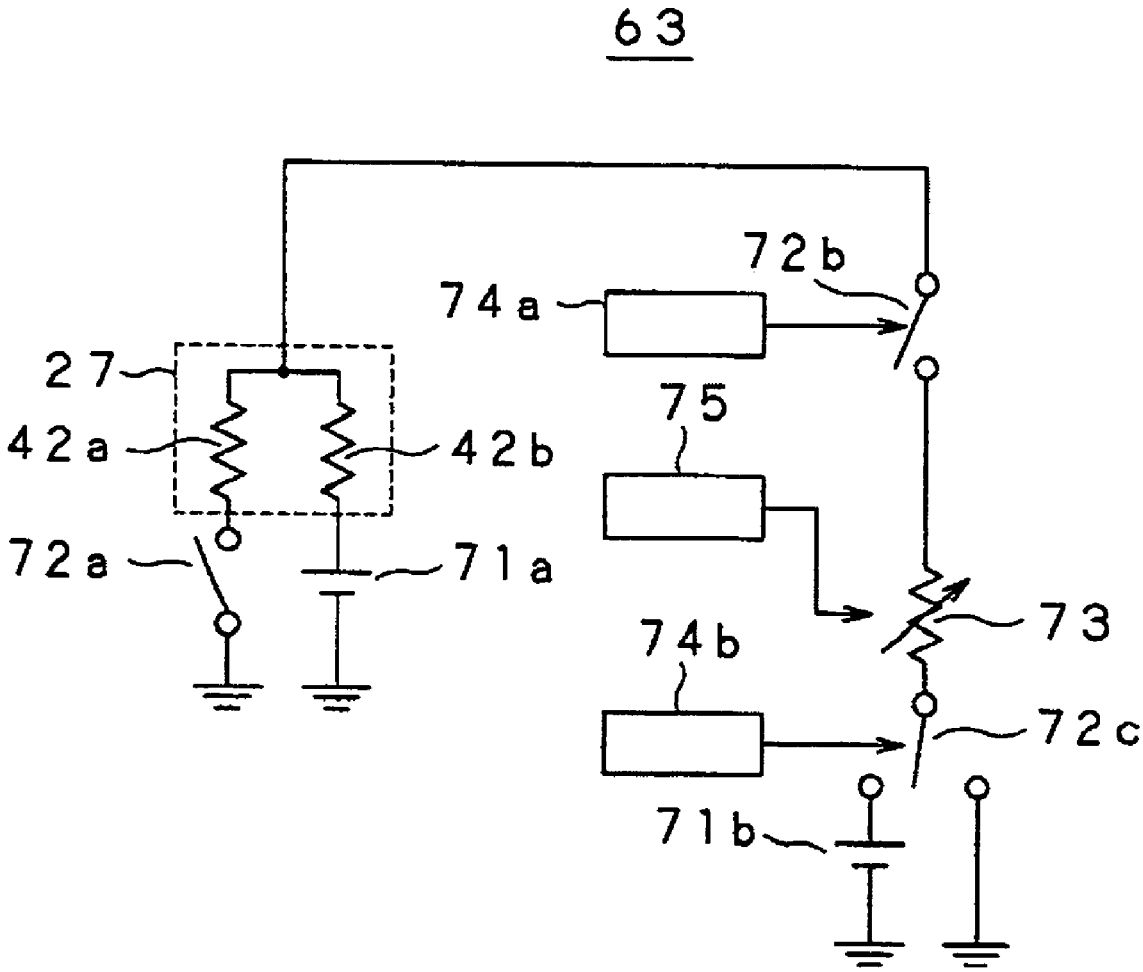
FIG. 18 is a schematic view of a discharge controller of the control circuit.

As illustrated in FIG. 18, the discharge controller 63 is an electric circuit including electric sources 71*a* and 71*b* for supplying pulse currents to the pair of heating resistors 42*a* and 42*b*, switching elements 72*a*, 72*b*, and 72*c* for turning on and off the electrical connection between the pair of heating resistors 42*a* and 42*b* and the electric sources 71*a* and 71*b*, a variable resistor 73 for controlling the pulse current applied to the pair of heating resistors 42*a* and 42*b*, switching control circuits 74*a* and 74*b* for controlling the switching of the switching elements 72*b*, and 72*c*, and a resistance control circuit 75 for controlling the resistance of the variable resistor 73.

The electric source 71*a* is connected to the heating resistor 42*b* and the electric source 71*b* is connected to the variable resistor 73 via the switching element 72*c*, wherein the electric sources 71*a* and 71*b* supply pulse currents to the electric circuit. The pulse current supplied to the electric circuit may be supplied from the electric sources 71*a* and 71*b* but may also be supplied directly from, for example, the controller 68.

The switching element 72*a* is interposed between the heating resistor 42*a* and controls the on and off switching of the entire discharge controller 63. The switching element 72*b* is interposed between the pair of heating resistors 42*a* and 42*b* and the variable resistor 73 and controls the pulse currents supplied to the pair of heating resistors 42*a* and 42*b*. The switching element 72*c* is interposed between the variable resistor 73 and the electric source 71*b* and controls the discharge direction of the ink droplets i. The switching elements 72*a*, 72*b*, and 72*c* switch on and off to control the pulse currents supplied to the electric circuit.

The variable resistor 73 changes the pulse current supplied to the heating resistor 42*a* by changing the resistance. In other words, the electric power supplied to the heating resistor 42*a* is determined according to the resistance of the variable resistor 73.

The switching control circuit 74*a* switches the switching element 72*b* on or off to connect or disconnect the variable resistor 73 and the pair of heating resistors 42*a* and 42*b*. The switching control circuit 74*b* switches the switching element 72*c* on or off to connect or disconnect the electric source 71*b* and the electric circuit.

The resistance control circuit 75 controls the resistance of the variable resistor 73 and adjusts the pulse current supplied to the heating resistor 42*a*.

In the discharge control circuit 63 having the above-described structure, a pulse current is supplied from the electric source 71*a* to a serially connected pair of heating resistors 42*a* and 42*b* (an electrical current is not supplied to the variable resistor 73) when the switching element 72*b* is turned off to disconnect the variable resistor 73 and the pair of heating resistors 42*a* and 42*b* and when the switching element 72*a* is turned on. At this time, if the resistances of the heating resistors 42*a* and 42*b* are substantially the same values, the amounts of heat generated by the heating resistors 42*a* and 42*b* when pulse currents are supplied are substantially the same.

Figure 19A:
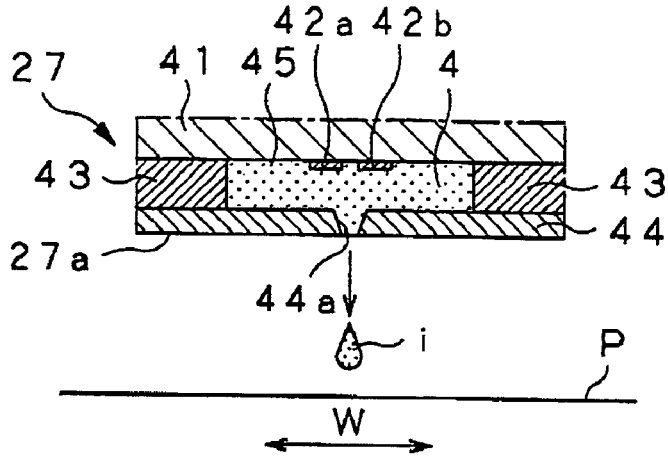
FIG. 19A is a schematic view of the ink droplet discharged substantially perpendicularly downward.

Since in such a case the amounts of heat generated by the heating resistors 42*a* and 42*b* are substantially the same, the length of the bubble generation time for the heating resistors 42*a* and 42*b* is substantially the same. As a result, as illustrated in FIG. 19A, the discharge angle of the ink 4 becomes substantially perpendicular to the main surface of the sheet of recording paper P and an ink droplet i is discharged directly downwards from the nozzle 44*a*.

Figure 19B:
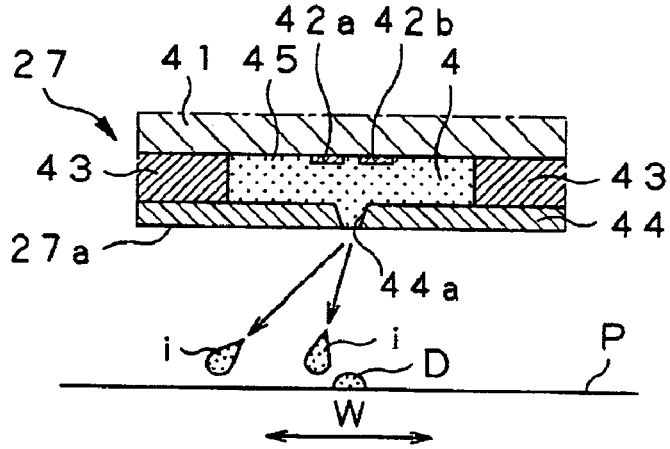
FIG. 19B is a schematic view of the ink droplet discharged substantially diagonally in the width direction of the sheet of a recording paper in respect to the center of the nozzle.

As illustrated in FIG. 18, in the discharge control circuit 63, when the switching element 72*b* switches on the connection between the pair of heating resistors 42*a* and 42*b* and the variable resistor 73, the switching element 72*a* is turned on, the switching element 72*c* is connected to a ground, and the discharge trajectory of an ink droplet i is displaced towards the heating resistor 42*a* in the width direction of the recording paper P indicated by an arrow W in FIG. 19B. In other words, by connecting the switching element 72*c* to the ground, the value of the pulse current supplied to the heating resistor 42*a* becomes smaller in accordance with the variable resistor 73. Accordingly, a difference is generated between the values of the pulse currents supplied to the heating resistors 42*a* and 42*b*. Thus, a difference also occurs in the amounts of heat generated in the heating resistors 42*a* and 42*b*.

A large resistance of the variable resistor 73 reduces the electric current that flows into the ground from the electric source 71*a* via the switching element 72*c*, so that the pulse current supplied from the electric source 71*a* to the heating resistor 42*a* is not reduced significantly. Consequently, the difference in the pulse currents supplied to the heating resistors 42*a* and 42*b* is reduced, and the difference in the amounts of heat generated by the heating resistors 42*a* and 42*b* is also reduced. As a result, the discharge angle of the ink droplet i discharged from the nozzle 44*a* increases relative to the discharge surface 27*a*. In other words, as the resistance of the variable resistor 73 increases, the ink droplet i lands to a position closer to the landing point D (which is the point where an ink droplet lands when discharged substantially perpendicularly to the nozzle 44*a*) relative to the heating resistor 42*a*. On the other hand, a small resistance of the variable resistor 73 increases the electric current that flows into the ground from the electric source 71*a* via the switching element 72*c*, so that the pulse current supplied from the electric source 71*a* to the heating resistor 42*a* is not reduced greatly. Consequently, the difference in the pulse currents supplied to the heating resistors 42*a* and 42*b* is reduced, and the difference in the amounts of heat generated by the heating resistors 42*a* and 42*b* is also reduced. As a result, the discharge angle of the ink droplet i discharged from the nozzle 44*a* decreases relative to the discharge surface 27*a*. In other words, as the resistance of the variable resistor 73 decreases, the ink droplet i lands to a position further away from the landing point D relative to the heating resistor 42*a*.

Figure 19C:
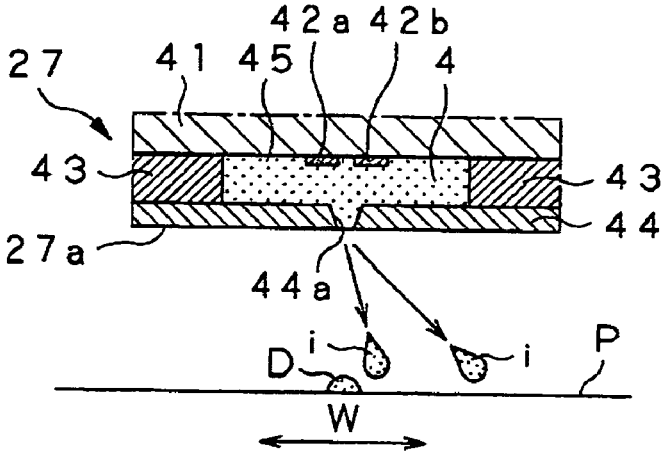
FIG. 19C is a schematic view of the ink droplet discharged substantially diagonally in the other width direction of the sheet of a recording paper in respect to the center of the nozzle.

As illustrated in FIG. 18, in the discharge control circuit 63, when the switching element 72*b* switches on to connect the pair of heating resistors 42*a* and 42*b* and the variable resistor 73, the switching element 72*a* is turned on, and the switching element 72*c* is connected to the electric source 71*b*, the discharge trajectory of an ink droplet i is displaced towards the heating resistor 42*a* in the width direction of the recording paper P indicated by an arrow W in FIG. 19C. In other words, by connecting the switching element 72*c* to the electric source 71*b*, the value of the pulse current supplied to the heating resistor 42*a* becomes larger in accordance with the variable resistor 73. Accordingly, a difference is generated between the values of the pulse currents supplied to the heating resistors 42*a* and 42*b*. Thus, a difference also occurs in the amounts of heat generated in the heating resistors 42*a* and 42*b*. In other words, the heat generating condition of the heating resistors 42*a* and 42*b* is opposite that when the switching element 72*c* is connected to the ground.

A large resistance of the variable resistor 73 reduces the sum of the pulse current supplied from the electric sources 71*a* and 71*b* to the heating resistor 42*a*, so that the difference in the pulse currents supplied to the heating resistors 42*a* and 42*b* is reduced, and the difference in the amounts of heat generated by the heating resistors 42*a* and 42*b* is also reduced. As a result, the discharge angle of the ink droplet i discharged from the nozzle 44*a* increases relative to the discharge surface 27*a*. In other words, as the resistance of the variable resistor 73 increase, the closer the ink droplet i lands to a position closer to the landing point D relative to the heating resistor 42*a*. On the other hand, a small resistance of the variable resistor 73 increases the sum of the pulse current supplied from the electric sources 71*a* and 71*b* to the heating resistor 42*a*, so that the difference in the pulse currents supplied to the heating resistors 42*a* and 42*b* is increased, and the difference in the amounts of heat generated by the heating resistors 42*a* and 42*b* is also increased. As a result, the discharge angle of the ink droplet i discharged from the nozzle 44*a* is reduced relative to the discharge surface 27*a*. In other words, as the resistance of the variable resistor 73 decreases, the ink droplet i lands to a position further away from the landing point D relative to the heating resistor 42*a*.

As described above, in the discharge control circuit 63, the switching elements 72*a*, 72*b*, and 72*c* are switched to change the resistance of the variable resistor 73. As a result, the discharge direction of the ink droplet i discharged from the nozzle 44*a* can be changed in the direction the heating resistors 42*a* and 42*b* are aligned or, in other words, the width direction of the recording paper P.

When a test pattern is printed on the main surface of the sheet of recording paper P to detect the color tone of the ink droplets i by the color tone detector 57 as a preliminary step for printing, in the discharge controller 63, the switching element 72*b* is periodically switched on and off by the switching control circuit 74*a*, the switching element 72*c* is periodically switched on and off by the switching control circuit 74*b*, the resistance of the variable resistor 73 is periodically changed by the resistance control circuit 75, and the discharge direction of the ink droplets i discharged from the nozzle 44*a* is periodically changed in the width direction of the recording paper P. In this way, the printer head 27 is controlled to prepare a test pattern having a color tone periodically changing on the surface of the recording paper P. In particular, the ink droplets i discharged while their discharge direction is changed in the width direction of the recording paper P, land on the left and right of the landing point D, which is the point where the ink droplets i land when they are discharged substantially perpendicularly downwards, within a range of about 40 μm.

Figure 17:
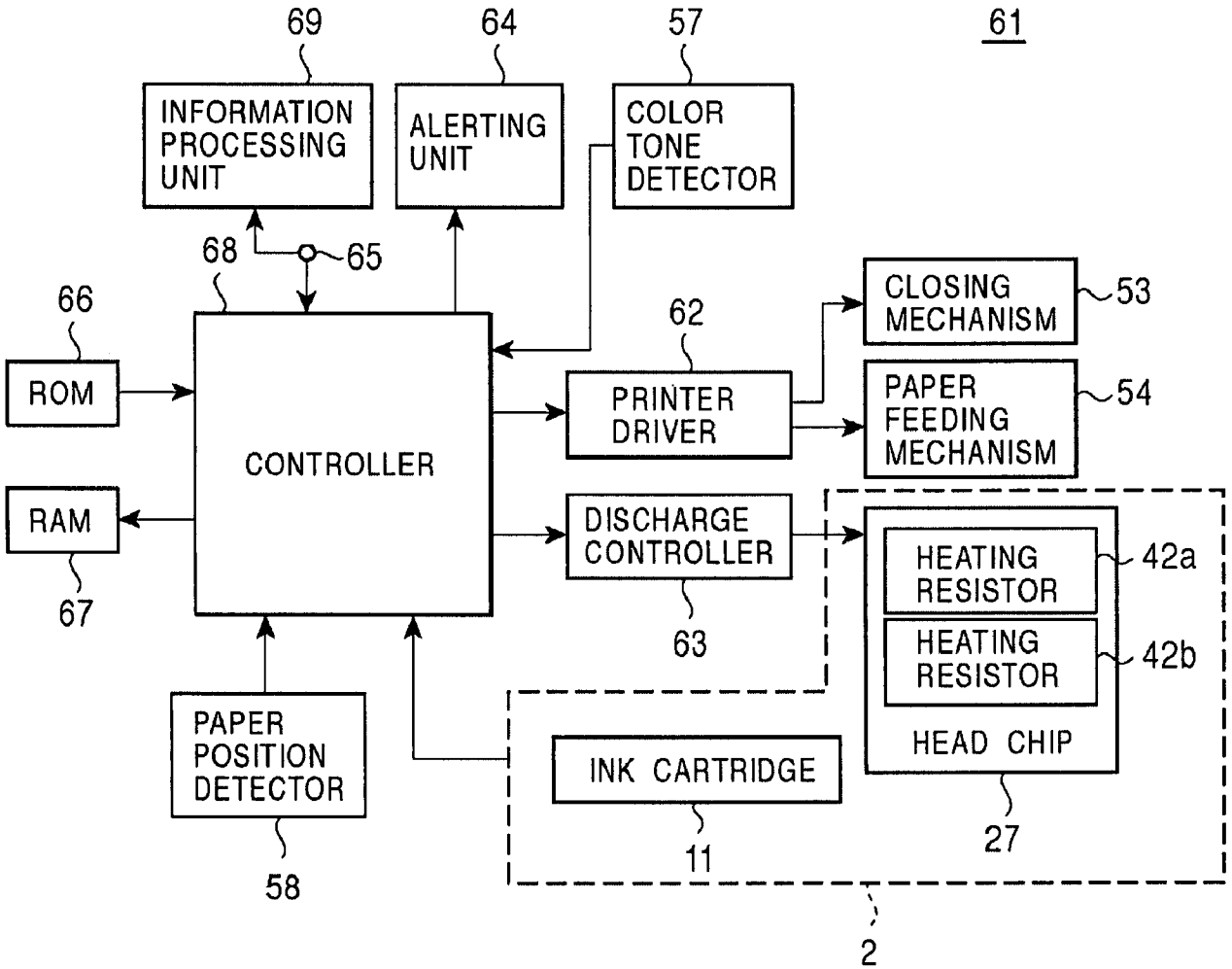
FIG. 17 is a block diagram illustrating control circuits of the inkjet printer.

The alerting unit 64, illustrated in FIG. 17, is a display unit such as a liquid crystal display (LCD), for displaying information such as the printing conditions, the printing state, and the remaining amount of ink. The alerting unit 64 may instead be an audio output unit such as a speaker to prove an audio output of information such as the printing conditions, the printing state, and the remaining amount of ink. The alerting unit 64 may also include both the display unit and the audio output unit. The alert may be provided by a monitor or a speaker of an information processor 69.

The input-output terminal 65 sends the information such as the printing conditions, the printing state, and the remaining amount of ink to the external information processor 69 via an interface. The input-output terminal 65 receives a control signal representing the information such as the printing conditions, the printing state, and the remaining amount of ink, printing data from the external information processor 69 and other units. The information processor 69 may be an electronic apparatus such as a personal computer, or a personal digital assistant (PDA). For example, when detecting a test pattern for detecting color tone printed on the sheet of recording paper P by an external color tone detector such as a scanner, the external color tone detector is connected to the input-output terminal 65. Parameters such as the average density and density distribution obtained by the color tone detector by reading the test pattern are sent to the controller 68 via the input-output terminal 65 as digitalized color tone signals.

The interface for the input-output terminal 65 connected to the information processor 69 may be a serial interface or a parallel interface. In particular, the interface should be in accordance with a universal serial bus (USB), a recommended standard (RC) 232C, or Institute of Electrical and Electronic Engineers (IEEE) 1394. The input-output terminal 65 may perform wire or wireless communication with the information processor 69. The wireless communication standard may be IEEE802.11a, 802.11b, or 802.11g.

The input-output terminal 65 and the information processor 69 may be connected via a network, such as the Internet. In such a case, the input-output terminal 65 is connected to a network, such as a local area network (LAN), a Digital Subscriber Line (xDSL), a Fiber-To-The-Home (FTHP), a community antenna television (CATV), or a broadcasting satellite (BS). The data communication is based on various protocols such as Transmission Control Protocol/Internet Protocol (TCP/IP).

The ROM 66 is a memory such as an erasable programmable read-only memory (EP-ROM) and stores processing programs run by the controller 68. The programs stored in the ROM 66 are loaded into the RAM 67 by the controller 68.

The RAM 67 stores programs read out from the ROM 66 by the controller 68 and data on the various conditions of the printer 1. The RAM 67 temporarily stores color tone signals sent from the color tone detector 57 to the controller 68 and sends the signals to the controller 68 when required.

The controller 68 controls each component based on the printing data sent from the input-output terminal 65, the color tone signals sent from the color tone detector 57, the distance signals sent from the paper position detector 58, and the data on the remaining amount of ink 4 sent from the head cartridge 2. The controller 68 reads out a processing program to control the components based on the input controlling signals from the ROM 66 and stores the program in the RAM 67 to control and process the components.

When the controller 68, for example, controls the discharge direction of the ink droplets i discharged onto the recording paper P, the color tone signal obtained by the color tone detector 57 by detecting the color tone of the test pattern printed onto the sheet of recording paper P and the distance signal representing data on the distance from the printer head 27 to the sheet of recording paper P when the test pattern was printed and detected by the paper position detector 58 are stored in the RAM 67. The controller 68 commands the RAM 67 to store the data on the pulse current supplied to the pair of heating resistors 42*a* and 42*b* for each line of ink droplets i on the sheet of recording paper P discharged from the plurality of nozzles 44*a* aligned in the width direction of the recording paper P. The controller 68 controls the switching on and off of the switching elements 72*b*, and 72*c* and the discharge controller 63 to adjust the resistance of the variable resistor 73 based on the color tone signals, distance signals, and pulse current data for each lines stored in the RAM 67. In this way, the controller 68 controls the switching elements 72*a*, 72*b*, and 72*c* and the discharge controller 63 to control the discharge angle of the ink droplets i discharged from the nozzles 44*a* of the printer head 27 so that the ink droplets i land on the surface of the recording paper P in a predetermined color tone.

In the control circuit 61 having the above-described structure, the ROM 66 stores the processing program. The medium for storing the processing program, however, is not limited to the ROM 66 and various recording media such as an optical disk, a magnetic disk, a magnetic optical disk, and an IC card may be used. In such a case, the control circuit 61 is connected to the driver of the recording medium directly or via the information processor 69 to read out the processing program from the recording medium.

Figure 20:
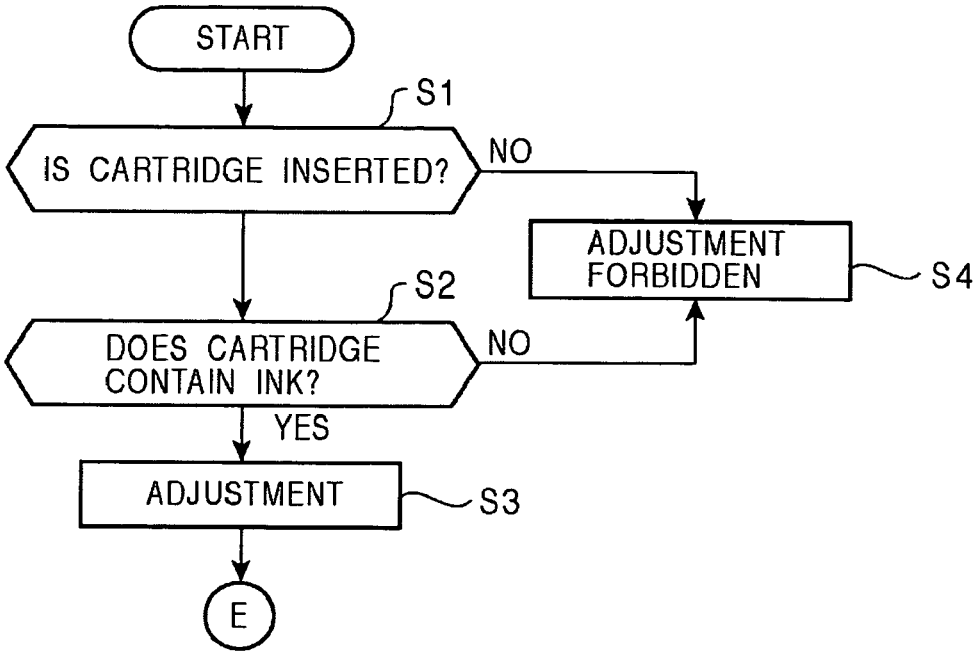
FIG. 20 is a flow chart describing the discharge direction adjustment operation of the inkjet printer.
Figure 21:
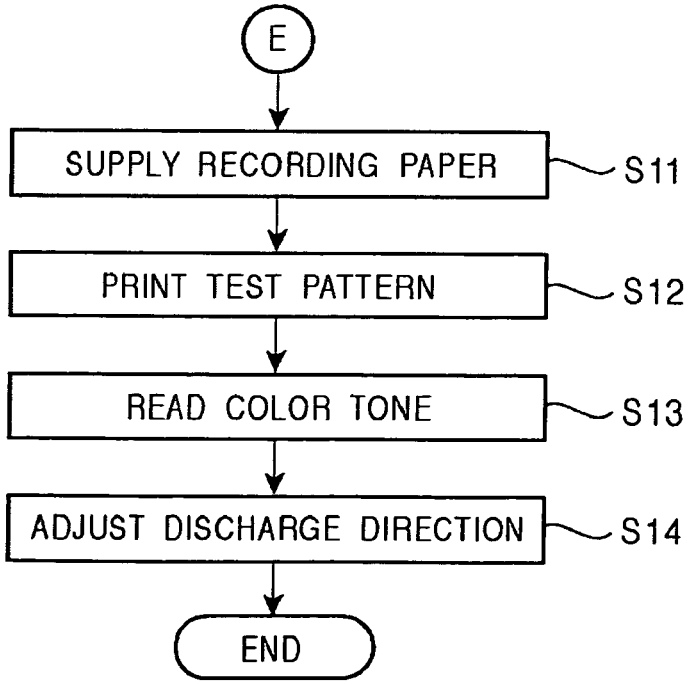
FIG. 21 is a flow chart describing the discharge direction adjustment operation of the inkjet printer.

The operation of the printer 1 having the above-described structure to adjust the discharge direction to obtain a predetermined color tone before the actual printing operation will now be described by referring to the flow charts illustrated in FIGS. 20 and 21. This operation is performed by a central processing unit (CPU) (not depicted in the drawings) disposed inside the controller 68 based on the processing program stored in the storing unit, such as the ROM 66. The discharge direction adjustment from obtaining the darkest color tone will now be described.

First, for the printer 1 to perform the operation to adjust the discharge direction of the ink droplets i to obtain the color tone required by a user, an operational signal is input via an operation panel on the printer body 3.

Next, in Step S1, the controller 68 determines whether the ink cartridge 11 of a predetermined color is disposed in the loading section 22. If the ink cartridge 11 of a predetermined color is disposed in every loading section 22, the process proceeds to Step S2. If the ink cartridge 11 of a predetermined color is not disposed correctly in the loading sections 22, the process proceeds to Step S4 and the adjustment operation is forbidden.

In Step S2, the controller 68 determines whether the amount of ink 4 in the connector 26 is less than a predetermined amount or, in other words, whether the ink 4 has run out. If the controller 68 determines that the ink has run out, the alerting unit 64 provides an alert. Then, in Step S4, the adjustment is forbidden. On the other hand, if the controller 68 determines that the amount of ink 4 in the connector 26 is more than a predetermined amount or, in other words, that the connector 26 is filled with ink 4, adjustment is performed in Step S3.

Figure 22:
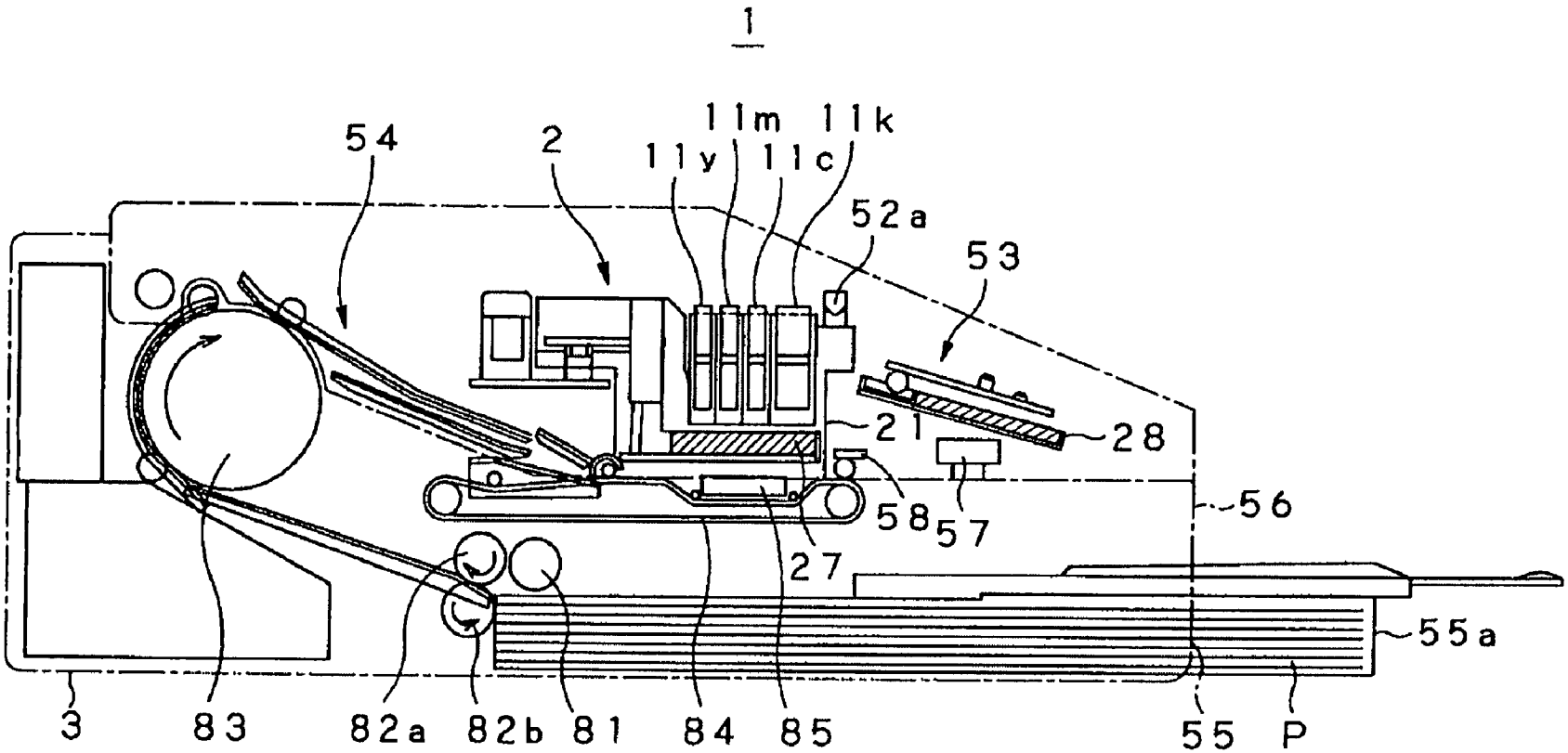
FIG. 22 is a side view of the inkjet printer partially showing the inner structure with an open head cap closing mechanism.

When adjustment is performed, first, in Step S11, the controller 68 commands the printer driver 62 to drive the head cap opening mechanism 53 and the paper feeding mechanism 54 so as to move the sheet of recording paper P to a position where printing can be performed. In particular, the controller 68 commands the printer driver 62 to drive the driving motor included in the head cap opening mechanism 53 so as to move the head cartridge 2 towards the tray 55*a* relative to the head cartridge 2 so that the nozzles 44*a* of the printer head 27 are exposed, as illustrated in FIG. 22.

The controller 68 commands the printer driver 62 to drive the driving motor included in the paper feeding mechanism 54 to feed the recording paper P. In particular, to determine the landing positions of the ink 4, the controller 68 controls the paper feeding mechanism 54 as described below: a sheet of recording paper P is pulled out from the tray 55*a* by a feeding roller 81; the sheet of recording paper P is sent to the reverse roller 83 by a pair of separating rollers 82*a* and 82*b* rotating in opposite directions; the delivery direction of the sheet of recording paper P is reversed by the separating rollers 82*a* and 82*b* and sent to a delivery belt 84; and, then, the sheet of recording paper P is held at a predetermined position with a holding unit 85.

Once the position of the sheet of recording paper P is determined, the controller 68 commands the switching control circuits 74*a* and 74*b* and the resistance control circuit 75 of the discharge controller 63 to control the switching elements 72*b*, and 72*c* and the variable resistor 73 in accordance with the processing program stored in advance in the ROM 66 in Step S12. In this way, the ink droplets i are disposed on the sheet of recording paper P as the discharge direction of the ink droplets i is changed periodically along the width direction of the recording paper P, or, in other words, a test pattern having periodically-changed color tones is printed.

When printing a test pattern, first the ink droplets i are discharged onto the main surface of the sheet of recording paper P substantially perpendicularly downwards from the nozzles 44*a* of the printer head 27, as illustrated in FIG. 19A. In this way, on the main surface of the sheet of recording paper P, ink droplets i are discharged onto the landing positions D opposing the nozzles 44*a* so as to print a test pattern having the lightest color tone (density) or, in other words, to print a test pattern having the least area occupied by the ink droplets i, as illustrated in FIG. 23A.

Next, the controller 68 switches the switching element 72*c* on and off while the resistance of the variable resistor 73 is increased by the discharge controller 63 to discharge the ink droplets i towards the left and right of the nozzles 44*a* in the width direction of the recording paper P, as illustrated in FIGS. 19B and 19*c*. Since the ink droplets i are discharged towards the left and right of the nozzles 44*a*, the ink droplets i land on the main surface of the sheet of recording paper P at landing position D distributed on the left and right of the position opposing the nozzles 44*a*, as illustrated in FIG. 23B. Therefore, the area of the main surface of the sheet of recording paper P not occupied by ink droplets i is smaller than that when the ink droplets i are discharged substantially perpendicularly downwards from the nozzles 44*a*. Thus, a test pattern having a darker color tone is printed.

Next, the controller 68 decreases the resistance of the variable resistor 73 by the discharge controller 63 and switches the switching element 72*c* on and off. In this way, as illustrated in FIGS. 19B and 19C, the ink droplets i are discharged towards the left and right of the nozzles 44*a* at an angle so that the ink droplets i do not overlap with each. As a result, the ink droplets i land at the landing points D on the main surface of the sheet of recording paper P without overlapping with each other, as illustrated in FIG. 23C. Thus, a test pattern having the most area occupied by ink droplets i or, in other words, a test pattern having the darkest color tone is printed.

Next, the controller 68 reduces the resistance of the variable resistor 73 by the discharge controller 63 so that the resistance is smaller than that when the color tone is the darkest and switches the switching element 72*c* on and off. In this way, as illustrated in FIGS. 19B and 19C, the ink droplets i are discharged towards the left and right of the nozzles 44*a* at an angle so that the ink droplets i partially overlap with each other. As a result, the ink droplets i land at the landing points D on the main surface of the sheet of recording paper P so that they partially overlap with each other, as illustrated in FIG. 23D. Thus, a test pattern having a smaller area (compared to the area occupied by the test pattern having the lightest color tone) occupied by the ink droplets i or, in other words, a test pattern having a lighter color tone (compared to the darkest color tone) is printed.

Next, the controller 68 commands the discharge controller 63 to reduce the resistance of the variable resistor 73 so that the resistance is smaller than that when the color tone is the darkest and switches the switching element 72*c* on and off. In this way, as illustrated in FIGS. 19B and 19C, the ink droplets i are discharged towards the left and right of the nozzles 44*a* at an angle so that the ink droplets i land in a position opposing the nozzles 44*a* on the left and right of the nozzles 44*a* that have discharged the ink droplets i. As a result, the ink droplets i land at the landing points D on the main surface of the sheet of recording paper P so that they oppose the nozzles 44*a* on the left and right of the nozzles 44*a* that have discharged the ink droplets i, as illustrated in FIG. 23E. Thus, a test pattern having the least area occupied by the ink droplets i or, in other words, a test pattern having the lightest color tone is printed again.

Figure 23:
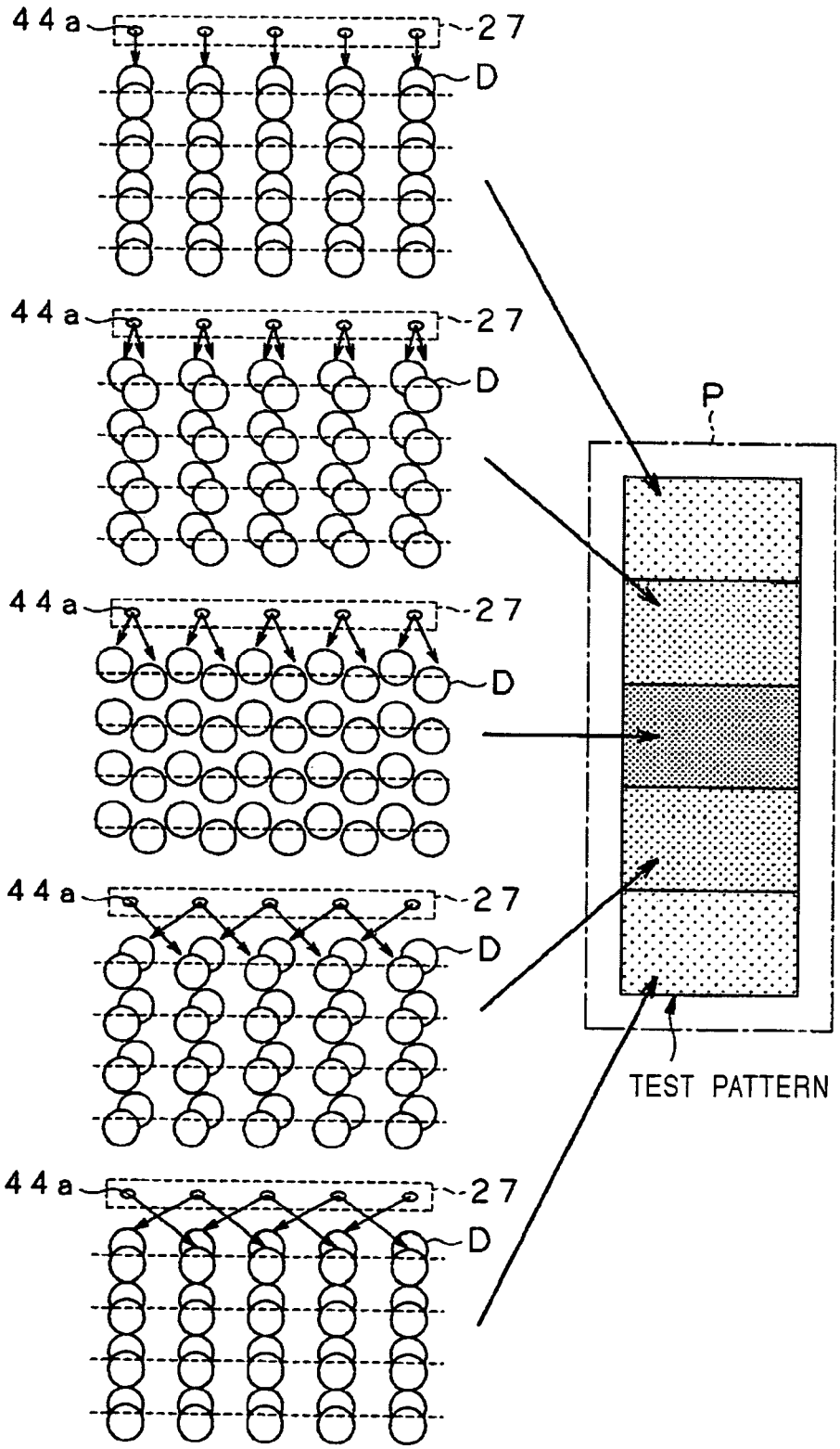

In this way, on the main surface of the sheet of recording paper P a test pattern is provided including a region of the lightest color tone, a region of a dark color tone, a region of the darkest color tone, a region of the dark color tone, and the region with the lightest color tone, in this order, as illustrated in FIG. 23. At this time, the controller 68 stores the values of the pulse currents supplied to the pair of heating resistors 42*a* and 42*b* for each line formed when the ink droplets i land on the recording paper P in the RAM 67. In other words, the controller 68 stores the values of the pulse currents supplied to the pair of heating resistors 42*a* and 42*b* while each color tone is printed as an electrical value signal. Here, a line is formed in the width direction of the recording paper P by the two ink droplets i discharged to the left and right of each of the nozzles 44*a* aligned in the width direction of the recording paper P. In FIG. 23, the lines formed by the ink droplets i are indicated by the dashed line.

At the same time, the controller 68 commands the paper position detector 58 to measure the distance from the discharge surface 27*a* of the printer head 27 to the main surface of the sheet of recording paper P of when the test pattern was printed. Then, the controller 68 stores the distance signal representing the digitalized values of the measurement results in the RAM 67.

In the above, a test pattern including different color tones printed in a periodical order from a light color tone to a dark color tone was described. The test pattern, however, may include different color tones printed in a periodical order from a dark color tone to a light color tone or including different color tones in a random order.

In Step S13, the color tone detector 57 of the printer 1 detects the color tone of the test pattern printed on the recording paper P and outputs a color tone signal representing digitalized parameters such as the density average of each line and the density distribution to the controller 68.

In Step S14, the color tone signal sent from the color tone detector 57 is stored in the RAM 67. Then, based on the color tone signal, the electric current value signal, the distance signal and the processing program stored in ROM 66 in advance, the discharge controller 63 is controlled so that a pulse current having substantially the same value as when the test pattern having the darkest color tone was printed is supplied to the heating resistors 42*a* and 42*b*. In this way, the discharge direction of the ink droplets i is adjusted. As a result, when the printer 1 performs printing, the ink droplets i can be discharged in a direction that produces the darkest color tone. Hence, high quality printing without unevenness in the color becomes possible.

In the above, the ink droplets i were discharged at an angle that will produce the darkest color tone. The discharged angle, however, is not limited to this. For example, by storing a processing program for the controller 68 to select a predetermined color tone in the ROM 66, the discharge angle of the ink droplets i may be adjusted so that a predetermined color tone can be obtained. The controller 68 may mark the different color tone in the test pattern with, for example, numbers. In this way, a user can input the mark (number) of the requested color tone through the operation panel of the printer body 3, and the discharge angle of the ink droplets i will be adjusted accordingly.

After adjusting the discharge angle of the ink droplets i as described above, the printer 1 prints the text data and printing data sent from the information processor 69 via the input-output terminal 65 on the main surface of the recording paper P.

In the above, the color tone of the test pattern was detected by the color tone detector 57 after the entire test pattern was printed. The operation of the color tone detector 57, however, is not limited to this, and the color tone of the test pattern may be detected while printing the test pattern. In the above, the color tone was detected by a color tone detector disposed inside the printer 1. The color tone detector, however, is not limited to this; the color tone of the test pattern may be detected by an external color tone detector, and the color tone signal according to the color tone detected by the external color tone detector may be sent to the controller 68 of the printer 1 via the input-output terminal 65. Furthermore, in the above, a distance signal was added to the color tone signal as a parameter for adjusting the discharge direction of the ink droplets i. When the distance from the nozzles 44*a* to the surface of the sheet of recording paper P is constant (such as in a case wherein printing is performed continuously on a sheet of recording paper P having substantially the same thickness), the discharge direction of the ink droplets i may be adjusted based on the color tone signal and the electric current value signal.

For the printer 1 capable of adjusting the discharge direction of ink droplets i, as described above, the electric currents supplied to the pair of heating resistors 42*a* and 42*b* may be controlled based on the color tone signal obtained by the color tone detector 57 detecting a test pattern printed on the main surface of the recording paper P, which has a different color tone, before starting printing. In this way, in the printer 1, the ink droplets i may be discharged from the nozzles 44*a* at a discharge direction that forms a predetermined color tone when the ink droplets i land on the sheet of recording paper P. Thus, images may be printed in high quality without any unevenness.

Since the printer 1 can adjust the discharge direction of the ink droplets i at once, a user does not have to visually observe the color tone of the printed image and adjust the discharge direction by adjusting the pulse currents supplied to the pair of heating resistors 42*a* and 42*b* to obtain an optimal color tone, as in known printers. Thus, the discharge direction of the ink droplets i may be easily adjusted to print high quality images.

When adjusting the discharge direction of the ink droplets i for the printer 1, the distance signal obtained by the paper position detector 58 is added as a parameter for adjusting the discharge direction. Therefore, images may be printed in a predetermined color tone on sheets of recording paper P having different thicknesses.

More specifically, when printing on a sheet of recording paper P thicker than the sheet of recording paper P on which a test pattern was printed, the distance from the nozzles 44*a* to thicker sheet of recording paper P is measured by the paper position detector 58. Since the distance from the nozzles 44*a* to the recording paper P is closer, the discharge angle of the ink droplets i is adjusted so that the discharge angle becomes larger relative to the center of the nozzles 44*a* based on the control signal on the difference of the obtained distance signal and the distance signal for the test pattern stored in the RAM 67 and the color tone signal stored in the RAM 67. In this way, an image having a predetermined color tone may be printed on the thicker sheet of recording paper P. On the other hand, when printing on a sheet of recording paper P thinner than the sheet of recording paper P on which a test pattern was printed, the distance from the nozzles 44*a* to the thinner sheet of recording paper P is measured by the paper position detector 58. Since the distance from the nozzles 44*a* to the recording paper P is further, the discharge angle of the ink droplets i is adjusted so that the discharge angle becomes smaller relative to the center of the nozzles 44*a* based on the control signal on the difference of distance and the color tone signal. In this way, an image having a predetermined color tone may be printed on the thinner sheet of recording paper P. To adjust the discharge direction of the ink droplets i when printing on sheets of recording paper P having different thicknesses, the adjustment may be based on a processing program stored in the ROM 66 so that a distance signal is automatically input to the controller 68 for each sheet of recording paper P, or, instead, a user may input a command signal from an operation panel on the printer body 3 when printing on a sheet of recording paper P having a different thickness.

Since the discharge direction of the ink droplets i can be adjusted easily for the printer 1 even when printing on sheets of recording paper P having different thicknesses, high quality images without unevenness can be printed on sheets of recording paper P having different thicknesses. Moreover, by inputting a distance signal to the controller 68 for each sheet of recording paper P used for the printing, high quality images without unevenness can be printed on the sheets of recording paper P even when a sheet of recording paper P having a different thickness is mixed into the stack of recording paper P.

According to the ink droplet discharge method described above, the discharge control method may be switched easily since the discharge angle of the ink droplets can be changed. In other words, the high quality printing method disclosed in, for example, Japanese Patent Application Nos. 2002-320861, 2002-360408, 2003-37343, 2003-55236, or the nozzle defect correction method disclosed in Japanese Patent Application No. 2003-32128 may be applied to the printer 1.

Figure 24A:
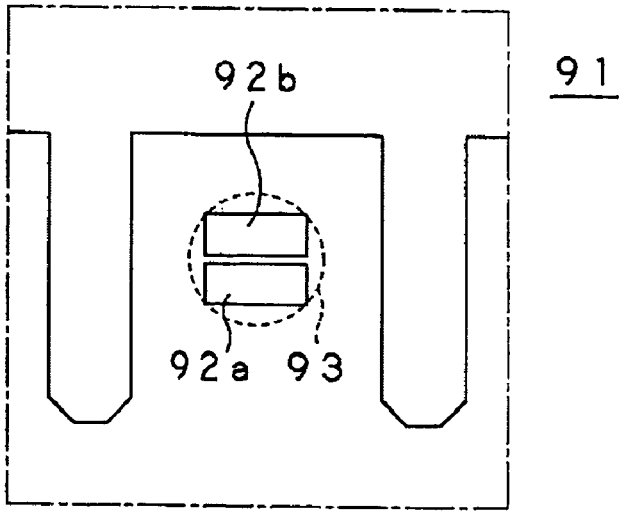
FIG. 24A is a plan view of heat resistors disposed serially in the feeding direction of the recording paper.
Figure 24B:
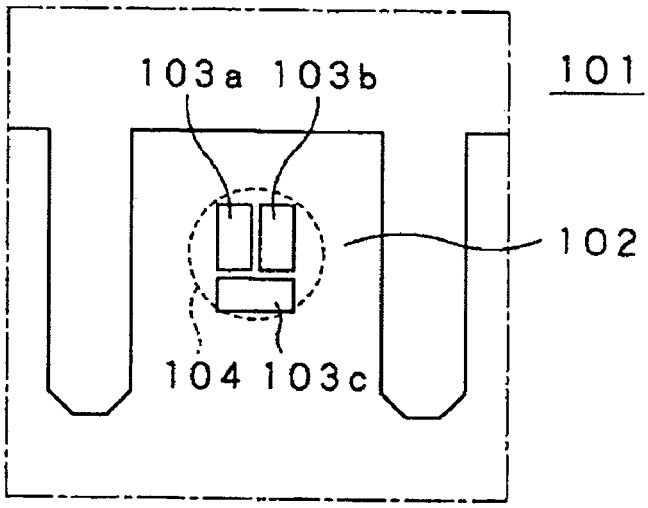
FIG. 24B is a plan view of three heat resistors disposed inside the ink chamber.
Figure 24C:
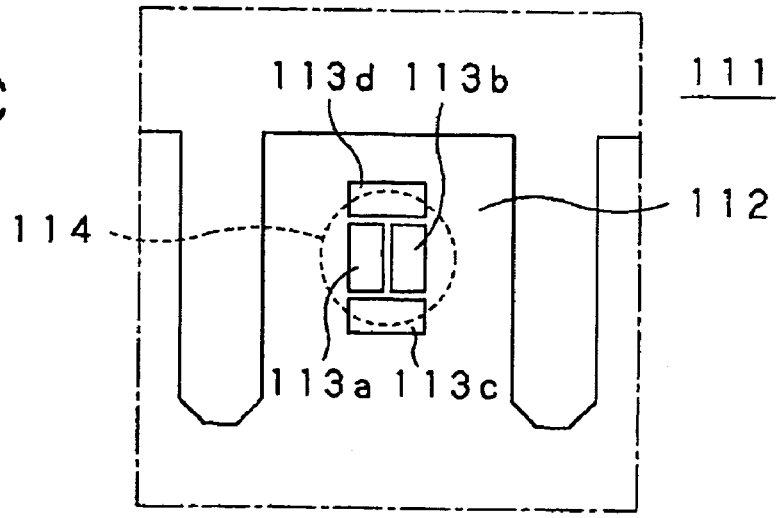
FIG. 24C is a plan view of four heat resistors disposed inside the ink chamber.

In the above-described printer 1, the printer head 27 has the pairs of heating resistors 42*a* and 42*b* aligned in parallel in the width direction of the recording paper P. The structure of the printer head 27, however, is not limited to the above-described structure. Any printer head that controls the discharge direction of the ink droplets i by changing the amount of energy supplied to a plurality of heating resistors can adjust the discharge direction of the ink droplets i by the methods described above. For example, printer heads 91, 101, and 111 illustrated in FIGS. 24A, 24B, and 24C, respectively, may be used. The printer head 91 includes a pair of heating resistors 92*a* and 92*b* aligned in parallel in the feeding direction of the recording paper P. The printer head 101 includes three heating resistors 103*a*, 103*b*, and 103*c* in an ink chamber 102. The printer head 111 includes four heating resistors 113*a*, 113*b*, 113*c*, and 113*d* in an ink chamber 112. In FIGS. 24A to 24C, the nozzles 93, 104, 114 for the printer heads 91, 101, and 111, respectively, are indicated by the dashed line.

In the above-described printer 1, the head cartridge 2 was removable from the printer body 3. Furthermore, the ink cartridge 11 was removable from the head cartridge 2. The printer body 3 and the head cartridge 2, however, may be an integral unit.

The above-described printer 1 prints text and images on the recording paper P. The present invention, however, may be applied to a wide range of apparatuses discharging a minute amount of liquid. For example, the present invention may be applied to a discharge apparatus for DNA chips in a liquid (Japanese Unexamined Patent Application Publication No. 2002-34560) or a liquid discharge apparatus for discharging a liquid including conductive particles for forming fine wiring patterns on a printed wiring board.

In the above-described printer 1, the ink 4 is discharged by electro-thermal conversion wherein the ink 4 is heated by the pair of heating resistors 42*a* and 42*b* and discharged from the nozzles 44*a*. The ink 4, however, may be discharged from the nozzles by an electro-mechanical conversion element such as a piezo-electric element.

The above-described printer 1 was a line printer. The printer 1, however, is not limited to this. The present invention may be applied to a serial inkjet printer having an ink head that moves in the direction substantially orthogonal to the paper feeding direction. In such a case, at least a plurality of pressure-generating elements is disposed on the printer head of the serial inkjet printer.

What is claimed is:

1. A liquid discharger capable of adjusting discharge angles, comprising:

ink chambers for holding liquid;

a supply unit for supplying liquid to the ink chamber;

at least two pressure-generating elements for pressuring the liquid in each of the ink chambers;

a discharging unit having outlets for discharging droplets of the liquid pressurized by the pressure-generating elements from the ink chambers;

a discharge controller for driving the pressure-generating elements and controlling the discharge angle of the droplets discharged from the outlets; and a color tone detector for detecting the color tone of a region where the droplets land on an object, wherein the discharge controller drives the pressure-generating elements based on a color tone signal sent from the color tone detector.

2. The liquid discharger according to claim 1, further comprising:

a measuring unit for measuring the distance from the outlets to the object;

wherein the discharge controller drives the pressure-generating elements based on a distance signal sent from the measuring unit.

3. The liquid discharger according to claim 1, wherein the outlets of the discharging units are aligned substantially linearly.

4. The liquid discharger according to claim 1, wherein the discharging unit controls the amount of energy to be supplied to the pressure-generating elements or the timing of the supply of the energy.

5. A liquid discharge adjustment method for adjusting a discharge angle for a liquid discharger comprising ink chambers for holding liquid, a supply unit for supplying liquid to the ink chamber, at least two pressure-generating elements for pressuring the liquid in each of the ink chambers, and a discharging unit having outlets for discharging droplets of the liquid pressurized by the pressure-generating elements from the ink chambers, the method comprising the steps of:

discharging droplets from the outlets while changing the discharge angle of the droplets by driving the pressure-generating elements by a discharge controller to control the discharge angle of the discharged droplets;

landing the droplets on an object while changing the discharge angle of the droplets;

detecting the color tone of a region where the droplets land on the abject by a color tone detector; and driving the pressure-generating elements by the discharge controller based on a color tone signal sent from the color tone detector.

6. The liquid discharge adjustment method according to claim 5, further comprising the steps of:

measuring the distance from the outlets to the object by a measuring unit; and driving the pressure-generating elements by the discharge controller based on a distance signal sent from the measuring unit.

7. The liquid discharge adjustment method according to claim 5, wherein the outlets ohhe discharge unit are aligned substantially linearly.

8. The liquid discharge adjustment method according to claim 5, further comprising the steps of:

controlling the amount of energy to be supplied or the timing of the energy to be supplied to the pressure-generating elements of the disebarge unit.

* * * * *